US010443329B2

(12) United States Patent
Savage et al.

(10) Patent No.: US 10,443,329 B2
(45) Date of Patent: Oct. 15, 2019

(54) DRILLING SYSTEM AND METHOD OF OPERATING A DRILLING SYSTEM

(71) Applicant: MANAGED PRESSURE OPERATIONS PTE. LTD., Singapore (SG)

(72) Inventors: Patrick David Savage, Queensland (AU); Christian Leuchtenberg, Singapore (SG)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 443 days.

(21) Appl. No.: 15/304,068

(22) PCT Filed: Apr. 14, 2015

(86) PCT No.: PCT/GB2015/051135
§ 371 (c)(1),
(2) Date: Oct. 14, 2016

(87) PCT Pub. No.: WO2015/159071
PCT Pub. Date: Oct. 22, 2015

(65) Prior Publication Data

US 2017/0037691 A1 Feb. 9, 2017

(30) Foreign Application Priority Data

Apr. 15, 2014 (GB) ..... 1406792.0

(51) Int. Cl.
*E21B 21/08* (2006.01)
*E21B 41/00* (2006.01)
(Continued)

(52) U.S. Cl.
CPC ..... *E21B 21/08* (2013.01); *E21B 41/0092* (2013.01); *E21B 44/06* (2013.01);
(Continued)

(58) Field of Classification Search
CPC ..... E21B 21/08; E21B 41/0092; E21B 44/06; E21B 46/00; E21B 47/0001;
(Continued)

(56) References Cited

U.S. PATENT DOCUMENTS 5,275,040 A 1/1994 Codazzi
5,842,149 A 11/1998 Harrell et al.
(Continued)

FOREIGN PATENT DOCUMENTS

CN 101446191 A 6/2009
GB 2 422 913 A 8/2006
(Continued)

OTHER PUBLICATIONS

"Functional safety: Essential to overall safety", IEC International Electrotechnical Commission, pp. 1-12 (2015).
(Continued)

*Primary Examiner* — Daniel P Stephenson
(74) *Attorney, Agent, or Firm* — Norman B. Thot

(57) ABSTRACT

A drilling system for drilling a subterranean well bore includes a controller and a first and a second set of field devices. Each of the first and second set of field devices measure a physical characteristic of the drilling system and to transmit to the controller signals representing a measured value of the physical characteristic. The controller is programmed to use a first set of algorithms to process the signals received from the first set of field devices to determine if the measured values represented by the signals indicate that there might have been an influx of formation fluid into the subterranean well bore, and a second set of algorithms to process the signals received from the second set of field devices to determine if the measured values
(Continued)

represented by the signals indicate that there might have been an influx of formation fluid into the subterranean well bore.

21 Claims, 7 Drawing Sheets

(51) Int. Cl.

| | |
|---|---|
| ***E21B 44/06*** | (2006.01) |
| ***E21B 47/12*** | (2012.01) |
| *E21B 7/12* | (2006.01) |
| *E21B 45/00* | (2006.01) |
| *E21B 47/00* | (2012.01) |
| *E21B 47/06* | (2012.01) |
| *E21B 47/10* | (2012.01) |

(52) U.S. Cl.
CPC ..... *E21B 47/12* (2013.01); *E21B 7/12* (2013.01); *E21B 45/00* (2013.01); *E21B 47/0001* (2013.01); *E21B 47/0007* (2013.01); *E21B 47/06* (2013.01); *E21B 47/065* (2013.01); *E21B 47/10* (2013.01)

(58) Field of Classification Search
CPC .... E21B 47/0007; E21B 47/06; E21B 47/065; E21B 47/10; E21B 47/12; E21B 7/12
See application file for complete search history.

(56) References Cited

U.S. PATENT DOCUMENTS

| | | | | |
|---|---|---|---|---|
| 6,233,524 | B1 | 5/2001 | Harrell et al. | |
| 6,325,159 | B1 * | 12/2001 | Peterman | E21B 21/001 166/350 |
| 2002/0112888 | A1 | 8/2002 | Leuchtenberg | |
| 2004/0153245 | A1 | 8/2004 | Womer et al. | |
| 2006/0016592 | A1 | 1/2006 | Wu | |
| 2006/0151215 | A1 | 7/2006 | Skogerbo | |
| 2007/0246261 | A1 | 10/2007 | Lowe et al. | |
| 2008/0262735 | A1 | 10/2008 | Thigpen et al. | |
| 2010/0147589 | A1 | 6/2010 | Wingky | |
| 2011/0214882 | A1 | 9/2011 | Santos | |
| 2011/0220410 | A1 * | 9/2011 | Aldred | E21B 44/00 175/26 |
| 2012/0241217 | A1 | 9/2012 | Davis et al. | |
| 2012/0274475 | A1 | 11/2012 | Milne et al. | |
| 2014/0110169 | A1 | 4/2014 | Santos et al. | |
| 2015/0068758 | A1 | 3/2015 | Leuchtenberg et al. | |
| 2015/0107898 | A1 | 4/2015 | Leuchtenberg | |
| 2015/0247396 | A1 * | 9/2015 | Tunc | E21B 44/00 700/275 |
| 2016/0222741 | A1 | 8/2016 | Lovorn et al. | |
| 2017/0037691 | A1 * | 2/2017 | Savage | E21B 21/08 |
| 2017/0096889 | A1 * | 4/2017 | Blanckaert | G05B 19/4065 |

FOREIGN PATENT DOCUMENTS

| | | | |
|---|---|---|---|
| GB | 2 501 741 | A | 11/2013 |
| WO | WO 02/50398 | A1 | 6/2002 |
| WO | WO 2004/012040 | A2 | 2/2004 |
| WO | WO 2011/109748 | A1 | 9/2011 |
| WO | WO 2012/166137 | A1 | 12/2012 |
| WO | WO 2013/082498 | A2 | 6/2013 |
| WO | WO 2013/153135 | A2 | 10/2013 |
| WO | WO 2014/066430 | A2 | 5/2014 |
| WO | WO 2015/073017 | A1 | 5/2015 |

OTHER PUBLICATIONS

"Functional safety and IEC 61508", IEC International Electrotechnical Commission, www.iec.ch/functionalsafety, English Abstract, pp. 1-2 (2010).

* cited by examiner

DRILLING SYSTEM AND METHOD OF OPERATING A DRILLING SYSTEM

CROSS REFERENCE TO PRIOR APPLICATIONS

This application is a U.S. National Phase application under 35 U.S.C. § 371 of International Application No. PCT/GB2015/051135, filed on Apr. 14, 2015 and which claims benefit to Great Britain Patent Application No. 1406792.0, filed on Apr. 15, 2014. The International Application was published in English on Oct. 22, 2015 as WO 2015/159071 A1 under PCT Article 21(2).

FIELD

The present invention relates to drilling system particularly for use in relation to floating installation for drilling an offshore subterranean bore hole for oil and/or gas production.

BACKGROUND

Subsea drilling typically involves rotating a drill bit from fixed or floating installation at the water surface or via a down hole motor at the remote end of a tubular drill string. It involves pumping a fluid down the inside of the tubular drill string, through the drill bit, and circulating this fluid continuously back to surface via the drilled space between the hole/drill string, referred to as the wellbore annulus, and the riser/drill string, referred to as the riser annulus. The drill string extends down through the internal bore of the riser pipe and into the wellbore, with the riser connecting the subsea blow out preventer (SSBOP) on the ocean floor to the floating installation at surface, thus providing a flow conduit for the drilling fluid and cuttings returns to be returned to the surface to the rig's fluid treatment system. The drill string is comprised of sections of tubular joints connected end to end, and their respective outside diameter depends on the geometry of the hole being drilled and their effect on the fluid hydraulics in the wellbore.

Conventionally, the well bore is open to atmospheric pressure and there is no surface applied pressure or other pressure existing within the system. The drill pipe rotates freely without any sealing elements imposed or acting on it at the surface, and flow is diverted at atmospheric pressure back to the rig's fluid treatment and storage system.

During drilling, responses and reactions to drilling parameters are based on the wellbore conditions from data streams at surface and down hole from drilling tools. Data streams such as weight on bit (WOB), rate of penetration (ROP), bit location, bottom hole pressure (BHP) and temperature (BHT), rotary RPM, drill pipe pressure or standpipe pressure (SPP), drilling injection rate or pump strokes (SPM), return flow rate, and applied surface pressure or choke pressure are used to make decisions for the adjustment of drilling parameters. Thus, drilling decisions use these in addition to practical experience to guide drilling throughout the entire drilling operation. Furthermore, high level or safety critical decisions over the course of the well are based on the available data streams, on site meetings, and verbal operating orders to rig and service personnel—a process prone to error. Time constraints, communication breakdown through misinterpretation or misunderstanding of standing orders, or other important restraints or limitations such as formation characteristics or equipment limitations may get overlooked.

This leads to an inefficient decision-to-action process, with a large degree of human error and a potential impact to productive time.

The bit penetrates its way through layers of underground formations until it reaches target prospects—rocks which contain hydrocarbons at a given temperature and pressure. These hydrocarbons are contained within the pore space of the rock i.e. the void space and can contain water, oil, and gas constituents—referred to as reservoirs. Due to overburden forces from layers of rock above, these reservoir fluids are contained and trapped within the pore space at a known or unknown pressure, referred to as pore pressure. An unplanned inflow of these reservoir fluids is well known in the art, and is referred to as a formation influx, or loss, and this may lead to a kick, commonly called a well control incident or event. For the purposes of this document, the words formation influx, loss and kick are viewed as interchangeable.

Furthermore, the infiltration of gas into the riser system creates an extremely hazardous situation, as the gas is now above the main safety barrier i.e. the subsea BOP and will continue to expand and increase in velocity as it migrates or circulates up the riser. This leads to the violent displacement/unloading and/or evacuation of the liquid volume from the riser. Ultimately, this could lead to an uncontrolled blow out of gas through the rig rotary table, which could be catastrophic to people, equipment and the environment.

Conventional methods of kick and loss detection and subsequent well control procedures are outdated and not particularly well suited for effectively monitoring and safely controlling these conditions in deep and ultra-deep water drilling especially for High Pressure and High Temperature (HPHT) wells. Well control event detection and subsequent control measures are time critical, and the longer the time lapse before a response is initiated, the bigger the subsequent influx volume, and the greater the resulting problems. This is even more critical when carrying out pre-salt drilling with fractured carbonates and higher pressure reservoirs, where the drilling window between the pore pressure and fracture pressure is quite narrow. The pitch and roll of the rig in response to the heave of the ocean results in changes to the return flow rate and variations in the active fluid system tank levels that can mask kick and loss events, resulting in a further time lapse before detection and appropriate response is implemented. Since time is critical when mitigating such events, early and accurate detection is essential.

Conventionally, safety critical procedures such as kick response have been manual decisions based on the interpretation of data streams from the rig that are compiled into the central control and processing unit, also referred to as the main drilling control and monitoring system (DCMS). Analysis of data over time within the main drilling control system alarms the rig of changes in flow or pressure parameters that may be positive kick indicators, but the final decision to react and implement the well shut in procedure is given by a manual verbal order followed by manual operations for the rig pumps, draw works, subsea BOP, and choke manifold. The standard sensors for offshore kick and loss detection are including but not limited to standpipe pressure, ROP, trip tank volume, active pit volume, return line flow rate, injected flow rate or pump strokes, drilling torque, drillstring weight, and gas detection at the shakers. All sensor data from the rig's standard kick detection system is processed through the rig's central processing unit (CPU), and the kick detection sensors form an integral part of the DCMS.

Third party Mudlogging services integrate additional sensors within the rig layout, heightening the monitoring capabilities of the rig and keeping existing rig sensors in check. Mudloggers connect various sensors and install specialized equipment to monitor or "log" drilling activity, monitoring for changes or trends in drilling parameters which may implicate kick or loss events. Mudloggers further monitor and interpret the well indicators in the mud returns during the drilling process, and at regular intervals log properties such as ROP, mud weight, flow line temperature, oil indicators, SPP, pump rate or SPM, gas analysis of shaker gas, lithology (rock type) of the drilled cuttings, and other data in addition to the existing rig sensor network. The Mudlogging system functions through an independent CPU, and operates externally to the DCMS.

Other third party companies provide downhole data, such as Measurement While Drilling (MWD) and directional drilling services. Formation data transmitted to surface from electronic downhole tools installed near the bit in the Bottom Hole Assembly (BHA), such as BHP, BHT, bit orientation, downhole WOB, and lithology. Changes in BHT and BHP can be positive indicators for kicks during drilling.

Conventionally, these are the standard independent monitoring systems providing the kick detection system on a floating installation.

Various methods of automation of drill processes for the optimisation of drilling are also known from other prior art drilling system.

During managed pressure drilling (MPD), additional equipment is installed at surface to create a closed loop drilling system which allows the application of applied surface or choke pressure to the riser and wellbore. Fluids are diverted through a flow spool installed within the riser, and use a pressure containment device to seal around the drill pipe to divert all returned flow to a flow line connected to the flow spool. All flow is routed through a mud gas separator (MGS) which degasses the fluid before it returns to the rig's fluid system. The MPD system uses choke pressure to maintain the BHP constant within the drilling window during drilling, circulating, and tripping periods. MPD is normally an automated system, using a number of drilling related parameters, including down hole data from the MWD/Directional service provider, to adjust the choke pressure to remain within the drilling window while simultaneously using advanced kick and loss detection modules to monitor the riser and wellbore annulus for loss and gain events. MPD services are usually provided through a third party contractor on the rig, however, more recently offshore drilling contractors are integrating MPD equipment as permanent infrastructure into their fleets. This is due to the growing demand for MPD techniques to safely and economically drill increasingly challenging reservoirs in deep and ultra-deep water. Such automated systems are described in patents U.S. Pat. No. 6,233,524 and U.S. Pat. No. 5,842,149, and adjust their parameters automatically or via a manual operator adjustment.

An automated drilling method is disclosed in patent application US2007/0246261, and describes a system where the AC electric motors which drive various drilling equipment are controlled by PLC's. A central control system monitors the variable frequency drive (VFD) of the electric motors, and utilizes user inputs to control the speed and torque of the pumps, draw works, and top drive systems used in drilling. This system is integrated into the rig's DCMS with a PLC system, allowing input of desired drilling parameters through a human machine interface (HMI). However, the system described in this application is applied to drilling and tripping optimization and not safety critical equipment functionality and well control safety.

Patent application WO 2013/082498 discloses another automated drilling system and method, using drilling parameter sensors in communication with a sensor application that generates processed data from raw data received from the drilling parameter sensor. A process application generates a command or instruction based on the processed data, and a priority controller evaluates the instruction before releasing the instruction to an equipment controller which then automatically manipulates one or more drilling parameters such as pump speed, WOB, etc. The described system is embedded within the DCMS and operates within its framework, is in bidirectional communication with drilling components, and can provide operating instructions to safety critical equipment such as BOP's in response to drilling parameters monitored by its sensors. However, it is stated the disclosed system is directed to control drilling processes, extending its application to MPD, kick detection, and drilling efficiency. Thus, the system described in this application is applied to drilling optimization and not safety critical equipment functionality and well control safety.

An automated event detection and response system for MPD is described in patent application US2012/0241217. This application discloses an automated drilling method for an MPD system that includes a drilling event detection (i.e. kick, loss, plugged choke, etc.) through processes of comparing parameter signatures generated during drilling to event signatures indicative of the drilling event. The proposed system automatically controls the drilling operation in response to a partial or full match between the event and parameter signatures. A sensor system on the rig continuously transmits data to a central CPU, and what occurs in the present drilling operation (the drilling parameter signatures) is compared to a set of drilling event signatures. The data streams are used to supply data indicative of the real time drilling properties, which is then used to determine drilling parameters of interest. The data is analysed to examine how each parameter is changing over time, and given appropriate values to generate drilling parameter signatures.

The event signatures do not represent what is occurring real time during drilling and are representative of what the drilling parameter behaviours are when the event happens, i.e. the expected data trends during a kick. The event and parameter signatures, when matched or partially matched, automatically adjust the choke or other parameters with no human intervention. The disclosed system is the progression towards automated kick detection, but operates on an independent CPU which is external to the rig's DCMS. Safety critical equipment such as the subsea BOP is not automatically operated and manual decisions are required for implementing the well control safety procedures.

Further progression of automated rig processes, remote control and manipulation of drilling parameters, and remote rig supervisory control are disclosed in patent applications US2010/0147589A1 and WO2004/012040A2.

Patent application US2010/0147589A1 describes a system and method for rig supervisory control through automation that includes replication and aggregation of supervisory control panels, mechanisms to manipulate these panels using smart algorithms, and a method and technique to access the supervisory control panels from a remote location. It includes a record, edit and playback function allowing an efficient operational sequence, such as bringing the pumps online, to be re-used on the rig or "played back" through its execution through the main DCMS.

Patent application WO2004/012040A2 describes a method for providing an automated rig control management system utilizing a hierarchical and authenticated communication interface to various third party contractor and drilling contractor parameters. It uses control models/algorithms for allocating and regulating drilling parameters according to constraints within the control management system.

However, the application for these systems and methods is for drilling optimization versus safety critical functionality. Decisions to change parameters, adjust equipment, or implement any given procedure remain a manual process.

Furthermore, the systems disclosed in the above patents are only useful if the data flow streams are handled and managed properly.

A system and method disclosed in patent application US2012/0274475 describes a sensor system on an offshore installation specifically for kick detection, and used to automatically react upon a confirmed kick event detected during drilling. Its control logic monitors, warns, and acts based on sensor input data to automatically detect and control a kick without requiring manual based decisions to be made by operations personnel. The sensor data is acquired and processed within a central CPU specific to the SSBOP, and using a step level decision to process the safety critical equipment such as the SSBOP and emergency disconnect system, which are automatically functioned in response to positive kick indicators from the sensors. However, the SSBOP CPU is external to the rig's DCMS architecture and the system disclosed in this patent is only useful if the data flow streams are handled and managed properly.

The rig's DCMS is a critical element for the safe and efficient operation of the rig throughout the drilling process, and is a software based system that acquires and compiles all sensor inputs and equipment controls into a central module for processing, display, and manipulation from a central console. Data outputs are displayed at various points on the rig such as the Company representative's office and rig manager's office. The CPU may be a single or series of computers, mini-computers, or microprocessors and includes programmed algorithms to perform automated commands which manipulate the rig equipment components. The DCMS includes memory storage devices, input and output devices, and operates on programmable logic controllers (PLC) well known in the art. They are generally connected to a server that responds to requests across a computer network to provide, or help to provide, a network service on the rig, and can be connected to and accessed remotely from, for example, offices onshore.

Such systems are provided through Aker Solutions MH control systems, who produce state of the art DCMS. The system accomplishes a high level of automation, such as remote control of equipment and systems, synchronization of equipment, fully automatic modes, and fully automatic modes with synchronized closed circuit television (CCTV) cameras and predefined drilling operation sequences through its configuration automatic drilling system (CADS). Predefined drilling sequences allow standardized operations and improve safety on the rig, and include smart zone management, set points, interlocks, and other safety features built into the software for efficient execution.

Aker's MH Operating Chair is the main human machine interface (HMI) for their DCMS, and allows total control of the rig's drilling parameters from a central console. It enables a full multi-user selection between the drilling operation modes, and focuses all drilling sensor and equipment data streams on the rig to this central monitoring location, normally situated in the driller's cabin. A touch screen interface is normally used for data entry and manipulation of equipment. Other DCMS and HMI systems may use a mouse, keyboard, and monitor hardware configuration.

The Aker MH DCMS and Operating Chair integrates mechatronics, a design process that includes a combination of mechanical engineering, electrical engineering, control engineering and computer engineering, to automatically manipulate and control equipment on the rig. These include, but are not limited to, robotic machines used for pipe handling and racking, crane operation, rig pump function, draw works operation, top drive function, and rotary table slips. However, the operation of the safety critical equipment, such as the SSBOP, is still performed manually during a kick event.

Within the AKER DCMS, the rig safety systems are provided with automated mechanical safeguards, disclosed in patent GB 2,422,913. The movements of mechanical devices within the automated system relative to the movements of other mechanical devices are prevented from colliding through the algorithms within the DCMS. A minimize function is implemented in the programmable logic controller (PLC) based on actual and calculated stop distances of the machine and used to stop machines before they collide. This mechanical safety system is extended to pipe handling on the rig, for example, preventing the hoisting of the drillstring if the elevators and the roughneck are both locked on the drillstring.

An enhanced kick detection sensor and monitoring system has been developed by the applicant, referred to as the Deepwater Kick Detection system (DKDS). This DKDS adds an additional, but more precise, third party sensor and monitoring system to the rig for enhanced kick and loss detection while operating in deep and ultra-deep water. A schematic illustration of a prior art drilling system including a DKDS is illustrated in FIG. 1, which shows a current AKER DCMS implemented on an offshore rig, revealing the various modules governing the rig systems, normal operating safety systems for the rig systems, and the well safety systems within the DCMS architecture.

The DCMS 1 consists of a central processing unit (CPU) 2 which may be a single or multiple microprocessors with memory and input and output devices, and includes Programmable Logic Controllers (PLC) to manipulate equipment. The CPU 2 is operably connected with mechanical, pneumatic and hydraulic controls of the offshore rig system modules 5, the rig's normal operating safety system module 7, and the well safety systems module 10. An internal communication bus may be in bidirectional communication with one or more of these modules'sensors or processes. A network interface allows bidirectional communication with external sources and users on the offshore installation, or alternately remotely to offices onshore. This permits remote monitoring of current processes during drilling.

The rig system module 5 comprises a multitude of mechanical, hydraulic, and/or pneumatic systems on the floating installation, including, but are not limited to, the drilling system (draw works, pumps, rotary table etc), the ballast tanks of the vessel, the riser tensioning system, the heave compensation system, and pipe handling equipment.

The rig's normal operating safety system module 7 typically comprises sensors 7A such as fluid level, fluid volume, pressure and temperature sensors, which monitor the mechanical systems operating on the rig, and an anticollision system 7B which is configured to detect if two pipe handling machines are moving towards one another. The anti-collision system is a feature provided within the control system which prevents pipe handling equipment from colliding during simultaneous operations that deal with the movement of drilling tubulars on the rig.

The fundamental module of the DCMS 1 is the well safety systems module 10 while modules 5 and 7 are the mechanical modules of the DCMS 1. It is the safety critical systems governed by the well safety module 10 that provide the necessary safeguards and protection to the environment, equipment and people from the risks of the wellbore being drilled with the floating installation. In this example, the well safety system module 10 comprises the SSBOP 11 and associated sensors 11, a diverter 12 and associated sensors 12*a*, a rig kick detection system 13 and associated sensors 13*a*, a riser gas handling/quick closing annular BOP (RGH/QCA) system and associated sensors 14*b* and CPU 14*a*, the DKDS 15 and associated sensors 15*b* and CPU 15*a*, and a mudlogging system and associated sensors 16*b* and CPU 16*a*. Whilst the RGH/QCA 14, DKDS 15 and Mudlogging 16 systems each have their own CPU 14A, 15A, 16A, the rig kick detection system 13 uses the central CPU 2, and hence its sensors 13*a* are in communication with the central CPU 2.

The systems operating within the architecture of the DCMS 10 are the SSBOP system 11 and associated sensors 11A, the diverter system 12 and associated sensors 12A, and the rig kick detection system 13 and associated sensors 13A. To enhance the kick detection and response of the floating installation, the Mudlogging system 16, its CPU 16A and associated sensors 16B, the DKDS 15, its CPU 15A and associated sensors 15B, and the RGH/QCA system 14, its CPU 14A and associated sensors 14B are three separate third party systems operating externally to the DCMS CPU 2 through their own independent CPU's 14A, 15A and 16A.

An example of a Riser Gas Handling (RGH) system is described in patent application WO2013153135. The RGH is an operating system for safely handling large influxes of gas in the riser and the resultant pressurized flow from the riser, and involves operating a rapidly closing riser sealing apparatus, referred to as the Quick Closing Annular (QCA), to seal off the riser at a point above a flow spool provided in riser. The core concept of the RGH is reducing the total kick volume and recovery time for any given kick event, referred to as Influx Volume Reduction (IVR), resulting in reducing the time and cost of well control incidents, reducing risk, and improving the management of well control. It utilises the diverting of flow through a flow spool to a choke valve provided in a riser gas handling manifold at surface, which is used to control the diverted flow from the riser to a high capacity gas rate mud gas separator (MGS) at surface. Here, the gas is safely separated from the fluid in a controlled manner and vented to atmosphere at a safe distance from the rig. The system compiles pressure, temperature and flow data into its CPU 14A, and even though an element of automation exists within its safety critical functionality, the final decision for its activation is a manual decision based on the data analysis. The resultant safety procedure upon its activation is disclosed in WO2013153135. This is an additional well safety system to the SSBOP and diverter systems on the rig, functions independently to the rig's critical safety equipment, and operates through its algorithms contained within its designated CPU 14A.

A data logger and storage device 4 is connected to the central CPU 2, and this allows the DCMS 1 to record, sort, and store all data feeds from the existing sensors on the rig. It is within the data logger and storage system 4 that the data is time stamped, presenting the data in a consistent format and allowing for the easy comparison of two or more different data records while tracking progress over time. A timestamp is the time at which an event is recorded by the CPU, not the time of the event itself. In many cases, the difference may be inconsequential—the time at which an event is recorded by a timestamp (i.e. entered into the data logger 4 file) should be close to the time of the event.

Data from sensors specific to the DCSM 1, i.e. the sensors which are connected to the main CPU 2, in this example the normal operating safety system sensors 7A, the anti-collision system 7B, the SSBOP sensors 11A, the diverter sensors 12A, and the rig kick detection sensors 13A, are sorted and stored using a detailed time stamping code assigned within the data logger and storage system 4. Using this data acquisition process, playback of an operational sequence or particular event is possible such that the DCMS 1 data can be examined closely for further analysis. The stored data within the data logger 4 can be retrieved at any time through the DCMS CPU 2.

An AKER MH Operator Chair Human Machine Interface (HMI) 3 is also connected to the central CPU 2, and is the main operator interface and control for manipulating the modules 5, 7 and 10 of the DCMS 1, described herein. The processed sensor data from the CPU 2 is transmitted and displayed on the Chair HMI 3, and manipulation of drilling parameters are achieved through commands prompted at the Chair HMI 3 and transmitted to the central CPU 2. From here, the hydraulic, pneumatic or mechanical control for the rig system module 5, normal operating safety system module 7, and/or the well safety system module 10 equipment can manipulated.

Generally all data streams are compiled through their respective CPU's and displayed on their separate remote monitors around the rig. Third party services, such as the DKDS and mudlogger systems described herein, install separate remote displays and stream their respective data in addition to the rig displays. Currently, all other sensor systems supplementary to the standard rig's sensor and monitoring system operate independently of and externally to the DCMS through their respective CPU's.

The rig system modules 5 and the normal operating safety system module 7 are generally mechanical aspects of the floating installation which govern the routine functions of the rig. These modules are linked such that the sensors 7A and anti-collision system 7B of the normal operating safety system module 7 are in fact the safety monitoring system for these functions occurring within the rig system modules 5. The bidirectional communication between these two modules 5 and 7 is performed through the CPU 2. Thus the rig safety system modules 5 receive sensor data 7A and anti-collision data 7B from the normal operating safety system module 7 through the CPU 2. All data is processed through the CPU 2 and transmitted to the Operator Chair HMI 3, and it is here where data streams are monitored and plotted and where rig system equipment manipulation is initiated. Alarms are raised at the Operator Chair HMI 3 if safety set points of any the rig systems are approached such that incidents or equipment problems are prevented. For example, if two pipe handling machines were moving towards one another the anti-collision system would detect this, an alarm would be raised at the HMI 3, and the machines would stop before they collided.

The SSBOP 11, the diverter 12, and the RGH/QCA 14 are considered the safety critical equipment of the well safety systems module 10. These are not data monitoring systems per say, but instead are the equipment and controls which provide the floating installation with its rudimentary well control safety response mechanism. Conventionally, these require manual decisions and human intervention for their operation, with the decision to function based on the kick detection data reliability from the sensors 13A, 15B and 16B of the monitoring systems 13, 15 and 16.

Hence, where the system shown in FIG. 1 is employed for advanced kick detection on floating installations three individual monitoring systems 13, 15 and 16 are used with three separate CPU's for processing their sensor data streams. However, multiple kick detection sources and data processing centres cannot be accurately defined as a well safety system. Each CPU 2, 15A, 16A produces their unique time stamped data within their associated data storage systems (not shown) from the raw data stream inputs originating from their sensors 13A, 15B and 16B. The raw data streams of each system are not compiled through a single standardized time stamping process due to the absence of a central CPU, and therefore the data quality control checking process occurring between the data streams is decentralized and not homogeneous. Thus, it is difficult to establish data reliability and quality control amongst all of the data streams being processed through each of their designated CPU's 2, 15A and 16A.

Therefore, with the system disclosed in FIG. 1, the operation of the SSBOP 11 and/or diverter 12 systems are based on questionable data reliability and quality, and therefore the degree of certainty in the decision to operate this safety critical equipment is decreased as a result. The well safety systems 11, 12, 13, 14, 15 and 16 operate individually to one another and systems 14, 15 and 16 function externally to the DCMS 1. A lack of automated processes results as the externally functioning systems 14, 15 and 16 are merely enhanced data monitoring systems requiring manual decision processes and manual functioning of the safety critical equipment. For example, the DKDS 15 may detect an influx with its sensor system 15B through the data analysis performed by its algorithms within its CPU 15A. This signals an alarm through the DKDS HMI interface (not shown), which prompts a manual decision from the operator to stop drilling and perform a flow check. If the flow check provides another positive indicator for an influx, another manual decision process is required to close the SS BOP 11. This is followed by the manual manipulation of the SS BOP 11 controls to shut in the wellbore.

Referring now to FIG. 2, this shows a schematic illustration of a modified version of the drilling system shown in FIG. 1. The modifications relate solely to the well safety systems, so in this diagram, for clarity, rig system modules 5 and the normal operating safety systems 7 are shown as External Sensor System 5, 7, and these are the same as and function in an identical manner to those described in relation to FIG. 1. Moreover, the SSBOP 11, the diverter 12, and the RGH/QCA 14 are still considered the safety critical equipment of the well safety systems module 10 and provide the identical function as described in FIG. 1. They still require manual decisions and human intervention for their operation and their functions are based on the quality control and resultant reliability of the data and sensor inputs 13A, 15B and 16B into the DKDS CPU 15A.

In the system shown in FIG. 2, the DKDS CPU 15A is the central CPU for the Mudlogging system 16 and the rig kick detection system 13, and thus the quality control check point or central acquisition point for their processed data. However, the rig kick detection system 13 continues to operate through the central CPU 2 of the DCMS 1 while the mudlogger system 16 continues to operate through its independent CPU 16A. The rig kick detection and Mudlogging raw sensor data 13A and 16B are first processed within their designated CPU's 2 and 16A before they transmit the data to the DKDS CPU 15A. Thus, it is the processed sensor data from these systems 13 and 16 which is transferred to the DKDS CPU 15A for quality control and validity checking. The raw sensor data inputs 15B of the DKDS 15 are processed within its CPU 15A. The DKDS CPU 15A ultimately becomes the central CPU for the kick detection monitoring systems.

The kick detection monitoring systems 13, 15 and 16 continue to operate externally to the DCMS 1 architecture, however. Separate CPU's 2, 15A and 16A still exist, thus creating distinct time stamped data stream inputs into the DKDS CPU 15A and resulting in different time stamping codes on the incoming data streams. The DKDS 15 would still be considered a third party monitoring system in FIG. 2, but the level of quality control on the data stream inputs 13A, 15B, 16B is improved when compared to the system disclosed in FIG. 1 and consequently enhances the data reliability. The algorithms within the DKDS CPU 15A compare and analyze the data streams from sensors 13A, 15B and 16B, and raise an alarm when there is a variance, deviation, or anomaly amongst the data.

For example, there may be stroke counter sensors installed on the rig pump for the rig kick detection system 15 and the Mudlogging system 16. These two systems combined do not enhance the detection monitoring, as stroke counters cannot calculate pump efficiency or detect loss of suction at the rig pump and operate solely on a volume displacement per stroke calculation. However, using an independent sensor installed on the suction of the rig pump, such as the highly accurate Coriolis flow meter sensor of the DKDS system 15, the actual flow rate into the pump can be measured precisely and the efficiency calculated accurately as a result. In this case, the pump strokes may indicate the correct flow rate is being injected into the drillpipe when in reality this may not be the case if pump suction issues are present. The DKDS CPU 15A would identify this within its algorithms; comparing the data stream inputs 13A 16B from the pump stroke counters of the rig kick detection 13 and Mudlogging 16 systems to the data stream inputs 15B from the Coriolis flow meter of the DKDS 15. It is at this point that an alarm would be raised through the DKDS 15 HMI (not shown).

The inability of the DKDS CPU 15A to process the raw data inputs from 13A and 16B is a disadvantage of the system presented in FIG. 2, as there are still multiple processing centres for the separate sensor data inputs 13A, 15B and 16B occurring through their independent CPU's 2, 15A and 16A. Thus a level of uncertainty still remains with respect to the data reliability and interpretation, but it is a significant improvement over the system disclosed in FIG. 1.

SUMMARY

An aspect of the present invention is to provide an integrated approach to data handling and management on offshore installations with respect to precise kick detection and automated response methods. More specifically, an aspect of the present invention is to provide a system and method to provide enhanced kick detection within the framework of an existing DCMS, resulting in automated decision processes and safety critical equipment function on the rig upon kick detection. Another aspect of the present invention is to provide for an improved well safety system within the rig's DCMS architecture that functions safety critical equipment based on reliable and accurate data inputs and interpretation through improved sensor accuracy and reliability, data verification, and equipment controls through a central and common CPU. Such a system may ultimately improve the well safety systems and the subsequent response time of the floating installation.

In an embodiment, the present invention provides a drilling system for drilling a subterranean well bore which includes a controller, and at least two sets of field devices comprising a first set of field devices and a second set of field devices. Each of the at least two sets of field devices are configured to measure a physical characteristic of the drilling system and to transmit to the controller signals representing a measured value of the physical characteristic. The controller is programmed to use a first set of algorithms to process the signals received from the first set of field devices to determine if the measured values represented by the signals indicate that there might have been an influx of formation fluid into the subterranean well bore. The controller is programmed to use a second set of algorithms to process the signals received from the second set of field devices to determine if the measured values represented by the signals indicate that there might have been an influx of formation fluid into the subterranean well bore.

BRIEF DESCRIPTION OF THE DRAWINGS

The present invention is described in greater detail below on the basis of embodiments and of the drawings in which.

DETAILED DESCRIPTION

Figure 1:
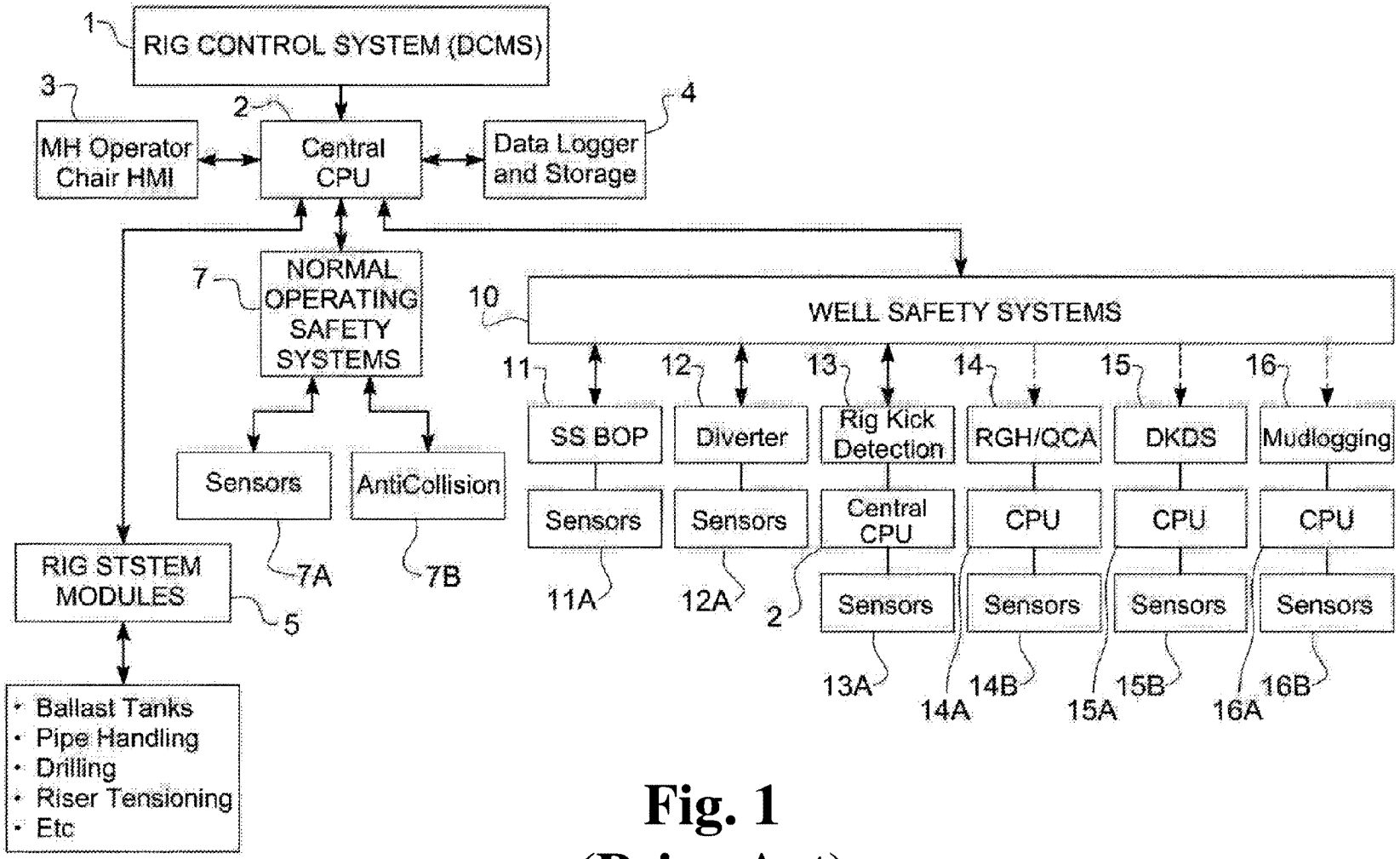
Fig. 1 (Prior Art)
FIG. 1 shows a schematic illustration of a prior art drilling system including a DKDS.

In an embodiment of the present invention, there is provided a system for drilling a subterranean well bore, the system comprising a controller, a plurality of drilling control devices, and a plurality of field devices, the controller being connected to the plurality of drilling control devices such that the controller can control drilling by effecting operation of the drilling control devices, the controller also being connected to the plurality of field devices, each of which is operable to measure a physical characteristic of the drilling system and to transmit to the controller a signal representing the measured value of the physical characteristic, wherein the controller is programmed to process the signals received from the field devices and to determine if the measured values represented by the signals indicate that there might have been an influx of formation fluid into the well bore.

The controller can, for example, include a microprocessor, or a plurality of microprocessors using a common clock signal, which receive(s) the signals from the field devices and which record(s) the time of receipt of each signal.

The controller can, for example, further includes a memory and is configured to record in the memory each signal received from the field devices and the time of receipt of the signal.

The drilling control devices may be operated using hydraulic, pneumatic or mechanical means.

The drilling control devices may include one or more of the following devices: draw works, drilling fluid injection pump, rotary table, riser tensioning devices, heave compensation devices, drill pipe handling equipment, flow control valve, diverter, blowout preventer, or rotating control device, or any combination thereof.

The field devices may comprise one of more of the following devices: pressure sensor, temperature sensor, flow meter, level sensor, volume sensor, displacement meter, fluid density meter, or any combination thereof.

The field devices may comprise one or more of the following devices: a standpipe pressure sensor, a rig pump injection Coriolis flow meter, a return line flow meter, a return line level switch, a trip tank level/volume sensor, a slip joint displacement sensor and a riser fluid density sensor, a rig injection pump stroke counter, an active pit level/volume sensor, a rig heave correlation sensor, a trip tank level/volume sensor, an Hookload/string weight/Weight on Bit sensor, a block position/ROP sensor, a subsea BOP and temperature sensor, and bottom hole temperature and pressure sensors, a shaker gas analysis sensor, or any combination thereof.

The system may further include a human machine interface which is connected to the controller, and which includes a display which is configured to display to an operator information relating to the signals received from the field devices and to provide an input apparatus whereby an operator may input control commands for effecting operation of the drilling control devices.

The controller may be programmed automatically to effect operation of one or more of the drilling control devices to control an influx of formation fluid into the well bore in response to the controller determining that an influx of formation fluid into the well bore has occurred.

The controller may be programmed to use a first set of algorithms to process the signals received from a first set of field devices to determine if the measured values represented by the signals indicate that there might have been an influx of formation fluid into the well bore, and to use a second set of algorithms to process the signals received from a second set of field devices to determine if the measured values represented by the signals indicate that there might have been an influx of formation fluid into the well bore, and to use a third set of algorithms to process the signals received from a third set of field devices to determine if the measured values represented by the signals indicate that there might have been an influx of formation fluid into the well bore.

In this case, the first, second and third set of field devices are each different but each set may include one or more field devices which measures the same physical characteristic of the drilling system as one or more of the field devices of one or both of the other sets. Each field device can, for example, be included in only one of the first, second, or third sets of field devices.

The controller may further be programmed such that if one of the sets of algorithms determines that there might have been an influx of formation fluid into the well bore, the controller automatically analyses the signals received from one of the other sets of field devices to corroborate this determination. In this case, if the set of field devices used by one of the other sets of algorithms includes a common field device which measures the same physical characteristic of the drilling system as the field device whose signal resulted in the determination that there might have been an influx of formation fluid into the well bore, the controller is advantageously programmed to analyse the signals received from the common field device to corroborate the determination.

The controller may be programmed to assign a numerical importance level to each of the field devices, to use, for example by adding, the importance levels of the field devices in each of the first, second or third set of field devices to give a safety score for each set, and to subtract from the safety score the importance level of any sensor determined to be faulty.

In this case, the controller may also be programmed to determine an aggregate safety score for the system by adding a first value to the aggregate safety score for each set of field devices with a safety score greater than a predetermined value, and adding a second value to the aggregate safety score for each set of field devices with a safety score less than the predetermined value, the aggregate safety score being reevaluated each time the safety score for any of the sets of field devices changes. In an embodiment, the first value is one and the second value is zero. In this example, where three sets of field devices are provided, the maximum aggregate safety score is three, and the aggregate safety score falls by one each time the safety score of one of the sets of field devices falls below the predetermined level. The predetermined level need not be the same for each set of field devices.

The controller may be programmed such that, when a field device is determined to be faulty, the controller determines whether or not there is another active field device which measures the same physical characteristic of the drilling system, assigns the faulty field device with a higher importance level if there is no such other field device and with a lower importance level if there is another active field device which measures the same physical characteristic of the drilling system, before recalculating the safety score of the set of field devices.

The controller may be programmed such that the importance level assigned to each field device depends on the type of drilling operation in progress at the time.

In an embodiment of the present invention, the controller is programmed to alert an operator if the aggregate safety score falls to a first predetermined level, and, if the aggregate safety score falls even further to a second predetermined level, automatically to operate the drilling control devices so as to implement an emergency shut-down procedure whereby drilling is stopped to allow for replacement or maintenance of the faulty field devices. In one example, the first predetermined level is 2 and the second predetermined level is 1.

In an embodiment of the present invention, a controller is provided for controlling a drilling system for drilling a subterranean well bore, wherein the controller is programmed to process signals received from a plurality of field devices, each of which is operable to measure a physical characteristic of the drilling system and to transmit to the controller a signal representing the measured value of the physical characteristic, to determine if the measured values represented by the signals indicate that there might have been an influx of formation fluid into the well bore, and automatically to control drilling by effecting operation of a drilling control device is response to a determination that there has been an influx of formation fluid into the wellbore.

The controller may have any of the features or any combination of the features of the controller of the present invention.

In an embodiment of the present invention, a system for drilling a subterranean well bore is provided, the system comprising a controller, and three sets of field devices, each of which is operable to measure a physical characteristic of the drilling system and to transmit to the controller a signal representing the measured value of the physical characteristic, wherein the controller is programmed to use a first set of algorithms to process the signals received from a first set of field devices to determine if the measured values represented by the signals indicate that there might have been an influx of formation fluid into the well bore, and to use a second set of algorithms to process the signals received from a second set of field devices to determine if the measured values represented by the signals indicate that there might have been an influx of formation fluid into the well bore.

The controller may be programmed to use a third set of algorithms to process the signals received from a third set of field devices to determine if the measured values represented by the signals indicate that there might have been an influx of formation fluid into the well bore.

The controller can, for example, include a microprocessor, or a plurality of microprocessors using a common clock signal, which receive(s) the signals from the field devices and which record(s) the time of receipt of each signal.

The controller can, for example, further include a memory and is configured to record in the memory each signal received from the field devices and the time of receipt of the signal.

The field devices may comprise one of more of the following devices: pressure sensor, temperature sensor, flow meter, level sensor, volume sensor, displacement meter, fluid density meter, or any combination thereof.

The field devices may comprise one or more of the following devices: a standpipe pressure sensor, a rig pump injection Coriolis flow meter, a return line flow meter, a return line level switch, a trip tank level/volume sensor, a slip joint displacement sensor and a riser fluid density sensor, a rig injection pump stroke counter, an active pit level/volume sensor, a rig heave correlation sensor, a trip tank level/volume sensor, an Hookload/string weight/Weight on Bit sensor, a block position/ROP sensor, a subsea BOP and temperature sensor, and bottom hole temperature and pressure sensors, a shaker gas analysis sensor, or any combination thereof.

The first, second and third set of field devices may each be different but each set may include one or more field devices which measures the same physical characteristic of the drilling system as one or more of the field devices of one or both of the other sets. Each field device can, for example, be included in only one of the first, second, or third sets of field devices.

The controller may further be programmed such that if one of the sets of algorithms determines that there might have been an influx of formation fluid into the well bore, the controller automatically analyses the signals received from one of the other sets of field devices to corroborate this determination. In this case, if the set of field devices used by one of the other sets of algorithms includes a common field device which measures the same physical characteristic of the drilling system as the field device whose signal resulted in the determination that there might have been an influx of formation fluid into the well bore, the controller is advantageously programmed to analyse the signals received from the common field device to corroborate the determination.

The controller may be programmed to assign a numerical importance level to each of the field devices, to use, for example by adding, the importance levels of the field devices in each of the first, second or third set of field devices to give a safety score for each set, and to subtract from the safety score the importance level of any sensor determined to be faulty.

In this case, the controller may also be programmed to determine an aggregate safety score for the system by adding a first value to the aggregate safety score for each set of field devices with a safety score greater than a predetermined value, and adding a second value to the aggregate safety score for each set of field devices with a safety score less than the predetermined value, the aggregate safety score being reevaluated each time the safety score for any of the sets of field devices changes. In an embodiment, the first value is one and the second value is zero. In this example, where three sets of field devices are provided, the maximum aggregate safety score is three, and the aggregate safety score falls by one each time the safety score of one of the sets of field devices falls below the predetermined level. The predetermined level need not be the same for each set of field devices.

The controller may be programmed such that, when a field device is determined to be faulty, the controller determines whether or not there is another active field device which measures the same physical characteristic of the drilling system, assigns the faulty field device with a higher importance level if there is no such other field device and with a lower importance level if there is another active field device which measures the same physical characteristic of the drilling system, before recalculating the safety score of the set of field devices.

The controller may be programmed such that the importance level assigned to each field device depends on the type of drilling operation in progress at the time.

In an embodiment of the present invention, the controller is programmed to alert an operator if the aggregate safety score falls to a first predetermined level, and, if the aggregate safety score falls even further to a second predetermined level, automatically to operate the drilling control devices so as to implement an emergency shut-down procedure whereby drilling is stopped to allow for replacement or maintenance of the faulty field devices. In one example, the first predetermined level is 2 and the second predetermined level is 1.

In an embodiment of the present invention, a controller for controlling a drilling system for drilling a subterranean well bore is provided, wherein the controller is programmed to process signals received from three sets of field devices, each field device being operable to measure a physical characteristic of the drilling system and to transmit to the controller a signal representing the measured value of the physical characteristic, wherein the controller is programmed to use a first set of algorithms to process the signals received from a first set of field devices to determine if the measured values represented by the signals indicate that there might have been an influx of formation fluid into the well bore, and to use a second set of algorithms to process the signals received from a second set of field devices to determine if the measured values represented by the signals indicate that there might have been an influx of formation fluid into the well bore, and to use a third set of algorithms to process the signals received from a third set of field devices to determine if the measured values represented by the signals indicate that there might have been an influx of formation fluid into the well bore.

The controller may have any of the features or any combination of the features of the controller of the present invention.

In an embodiment of the present invention, the is provided a method of operating a drilling system comprising a controller, and three sets of field devices, each of which is operable to measure a physical characteristic of the drilling system and to transmit to the controller a signal representing the measured value of the physical characteristic, the method comprising the steps of using a first set of algorithms to process the signals received from a first set of field devices to determine if the measured values represented by the signals indicate that there might have been an influx of formation fluid into the well bore, using a second set of algorithms to process the signals received from a second set of field devices to determine if the measured values represented by the signals indicate that there might have been an influx of formation fluid into the well bore, and using a third set of algorithms to process the signals received from a third set of field devices to determine if the measured values represented by the signals indicate that there might have been an influx of formation fluid into the well bore.

In an embodiment of the present invention, if one of the sets of algorithms determines that there might have been an influx of formation fluid into the well bore, the method includes automatically analysing the signals received from one of the other sets of field devices to corroborate this determination.

If the set of field devices used by one of the other sets of algorithms includes a common field device which measures the same physical characteristic of the drilling system as the field device whose signal resulted in the determination that there might have been an influx of formation fluid into the well bore, the method may include analysing the signals received from the common field device to corroborate the determination.

The method may further include assigning a numerical importance level to each of the field devices, using the importance levels of the field devices in each of the first, second or third set of field devices to give a safety score for each set, and subtracting from the safety score the importance level of any sensor determined to be faulty.

The method may further includes determining an aggregate safety score for the system by adding a first value to the aggregate safety score for each set of field devices with a safety score greater than a predetermined value, and adding a second value to the aggregate safety score for each set of field devices with a safety score less than the predetermined value, the aggregate safety score being reevaluated each time the safety score for any of the sets of field devices changes. In an embodiment, the first value is one and the second value is zero. In this example, where three sets of field devices are provided, the maximum aggregate safety score is three, and the aggregate safety score falls by one each time the safety score of one of the sets of field devices falls below the predetermined level. The predetermined level need not be the same for each set of field devices.

When a field device is determined to be faulty, the method may include determining whether or not there is another active field device which measures the same physical characteristic of the drilling system, assigning the faulty field device with a higher importance level if there is no such other field device and with a lower importance level if there is another active field device which measures the same physical characteristic of the drilling system, before recalculating the safety score of the set of field devices.

The importance level assigned to each field device may depend on the type of drilling operation in progress at the time.

The method may include alerting an operator if the aggregate safety score falls to a first predetermined level, and, if the aggregate safety score falls even further to a second predetermined level, automatically operating drilling control devices so as to implement an emergency shut-down procedure whereby drilling is stopped to allow for replacement or maintenance of any faulty field devices. In one example, the first predetermined level is 2 and the second predetermined level is 1.

In an embodiment of the present invention, a computer readable medium is provided having instructions stored thereon that, when executed, cause a controller to operate in accordance with the method of the present invention.

Embodiments of the present invention will now be described, by way of example only, with reference to the accompanying drawings.

Figure 2:
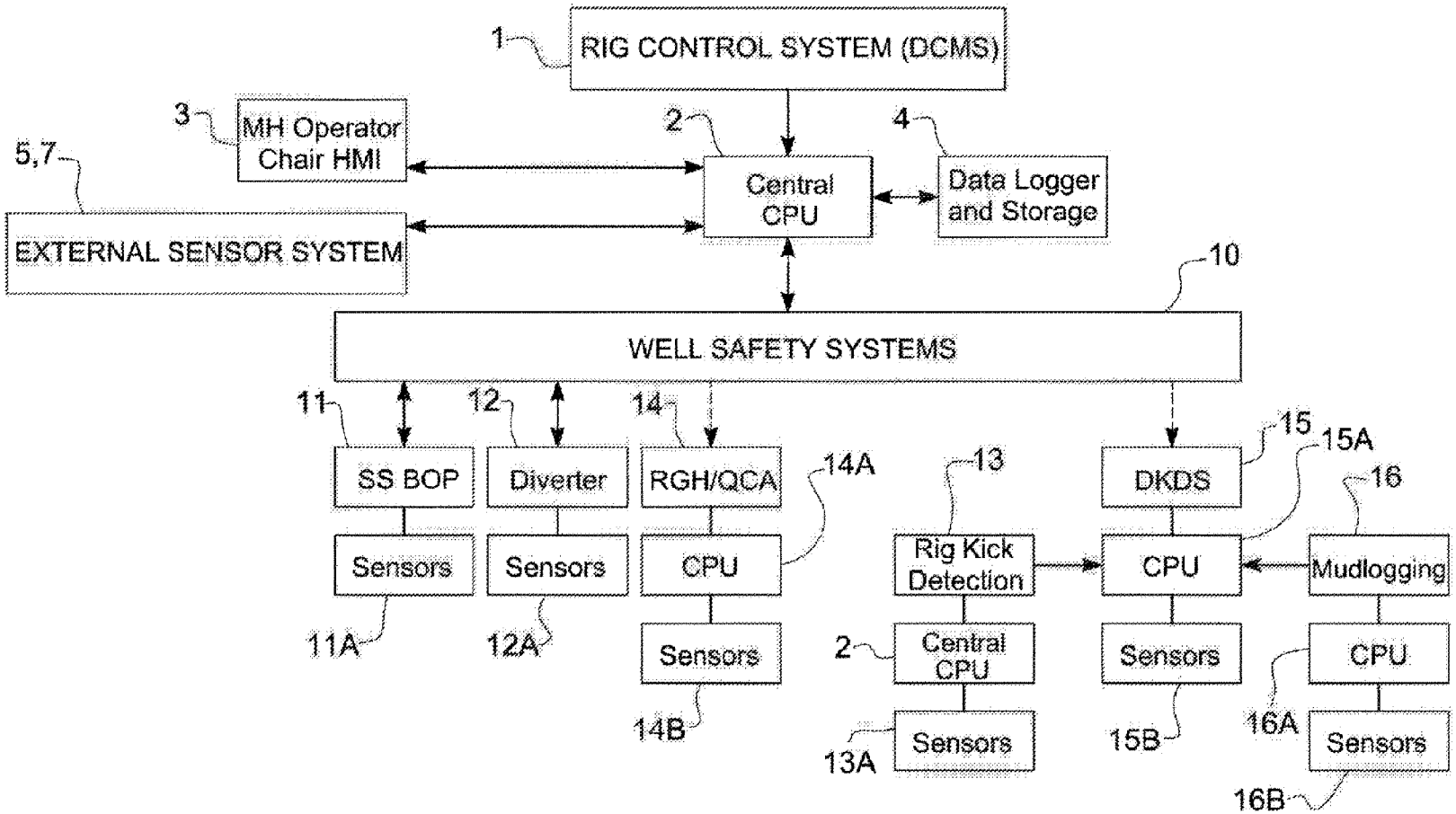
Fig. 2 (Prior Art)
FIG. 2 shows a schematic illustration of a modified version of the drilling system shown in FIG. 1.
Figure 3:
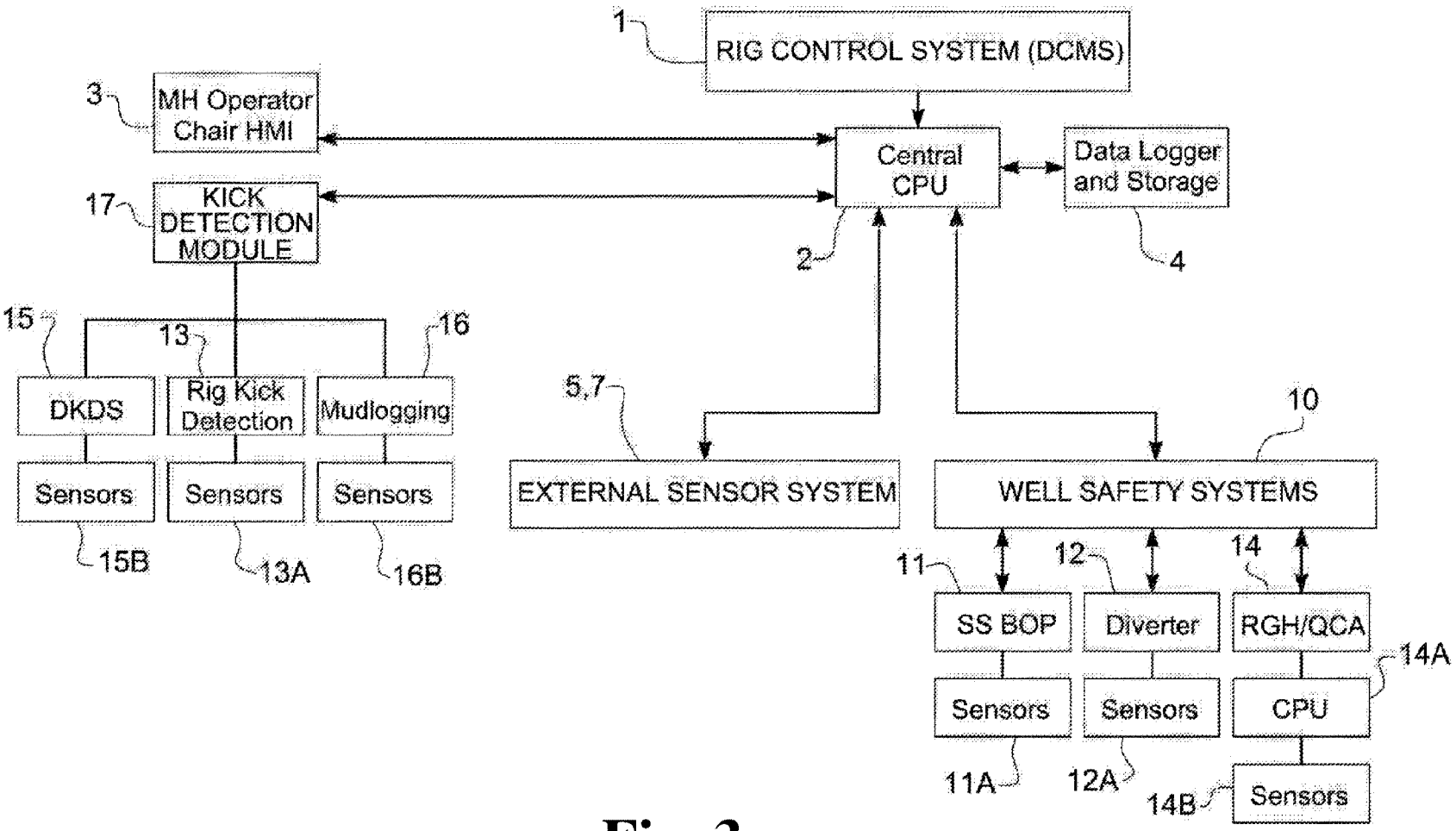
FIG. 3 shows a schematic illustration of a drilling system according to the present invention.
Figure 4A:
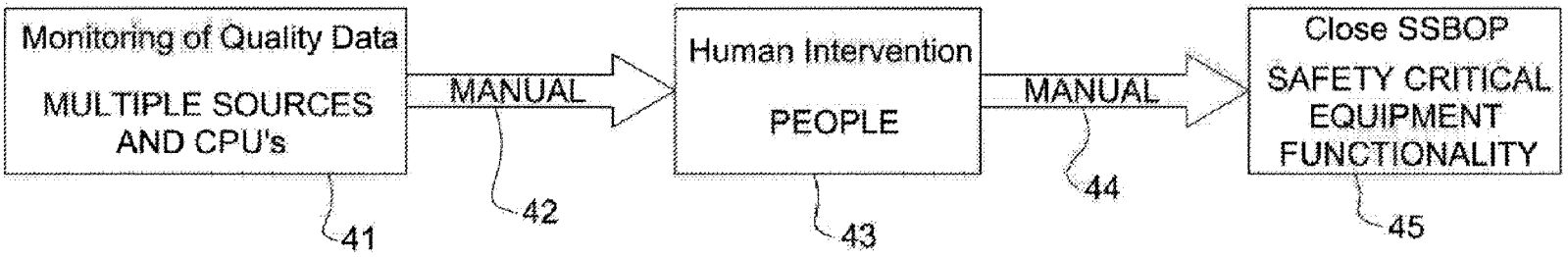
Fig. 4A (Prior Art)
FIG. 4 shows a flow chart diagram illustrating the progression of kick detection data monitoring, data quality control, and critical equipment functionality from the prior art (4A & 4B) and systems according to the present invention (4C & 4D)
Figure 4B:
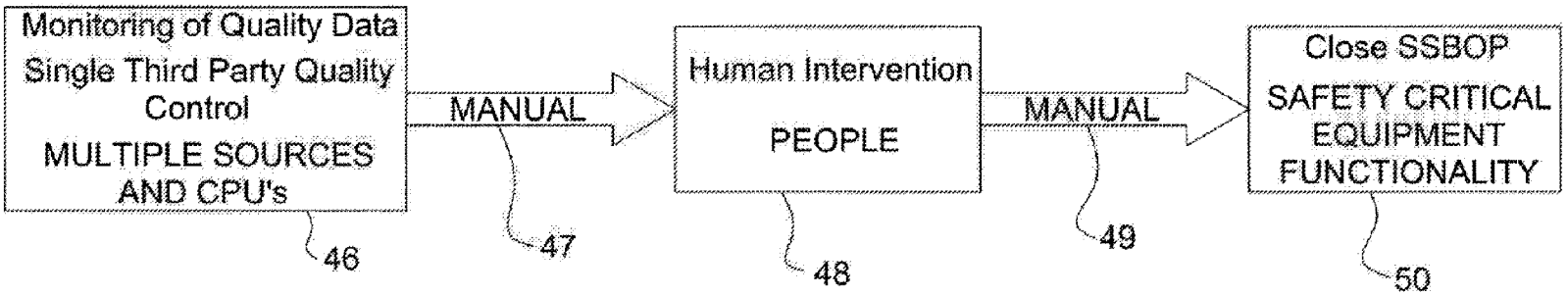
Fig. 4B (Prior Art)
Figure 4C:
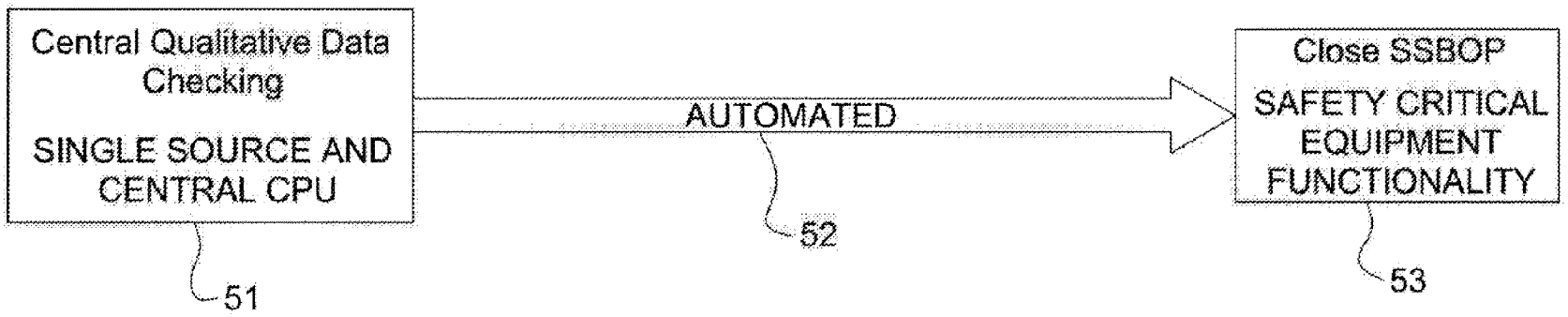
Figure 4D:
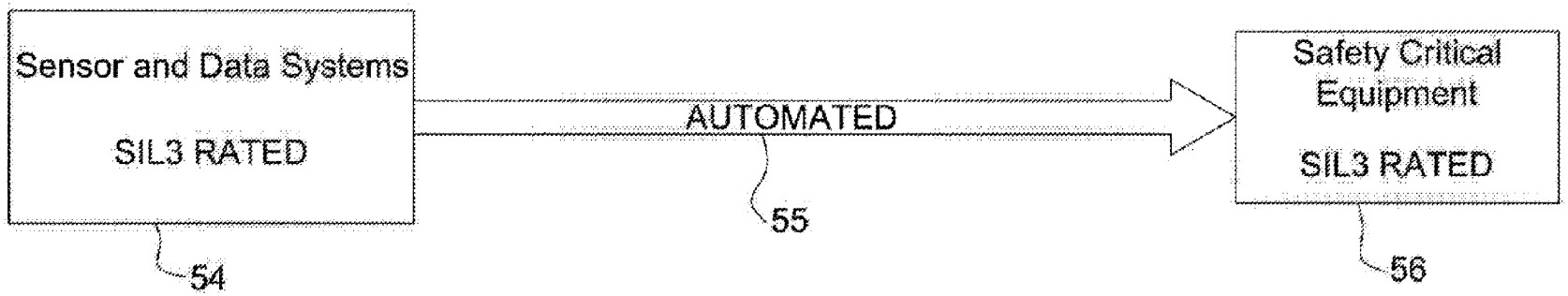

Referring now to FIG. 3, a diagram revealing the proposed inventive system, illustrating the complete assimilation of the kick detection monitoring systems into the architecture of the DCMS 1. This system is similar to that described in relation to FIGS. 1 and 2 in that it includes a controller—central CPU 2 which are connected an AKER MH Operator Chair HMI 3, a data logger and storage device 4, external safety systems including a plurality of drilling control devices within the rig system modules 5 and the normal operating safety systems 7, and a well safety systems module 10 which includes a SSBOP 11 and associated sensors 11A, a diverter 12 and associated sensors 12A, and a RGH/QCA 14 and associated CPU 14A and sensors 14B. All these parts of the systems are exactly as described above in relation to FIGS. 1 and 2, and function in the same way, except that the well safety systems module 10 no longer includes the DKDS 15, the rig kick detection system 13 or the mudlogger 16. Instead, a new module, referred to as the kick detection module 17, is embedded within the internal framework of the DCMS 1 with all raw sensor data processing performed within the central CPU 2, and so the external third party data monitoring and sensor systems and associated CPU's from the prior art are eliminated from the well safety systems module 10.

The kick detection module 17 is comprised of three sets of field devices each of which device is operable to measure a physical characteristic of the drilling system and to transmit to the controller (central cPU2) and signal representing the measure value of the physical characteristic. The three sets of field devices (hereinafter referred to as sensors) are sublevel sensor systems 13, 15 and 16, each of which has a unique set of independent sensors 13A, 15B and 16B as described in the prior art. However, the DCMS 1 CPU 2 now becomes the common data processing and quality control centre for these systems 13, 15 and 16. Thus, the raw sensor data feeds from the sensors 13A, 15B and 16B of these systems 13, 15 and 16 are independent inputs into the kick detection module embedded within the central CPU 2. The CPU 2 receives the raw sensor data inputs and assigns a common timestamp code to the incoming data streams, and then stores the data within the data logger and storage system 4 now common to all three subsystems 13, 15 and 16. This results in a single and consistent quality control and interpretation processing centre for the entire array of kick detection monitoring data within the DCMS 1. Each system 13, 15, 16 has its own set of algorithms within the central CPU 2, and these sort, compare, and analyse the raw data streams from the sensors 13A, 15B and 16B in an identical methodology as disclosed in FIG. 2.

However, the major difference with the system shown in FIG. 3 is the absence of multiple data processing centres through multiple CPU's. Thus, with the DCMS CPU 2 acting as a single data processing focal point, the quality control and interpretation of data is greatly enhanced. The compilation and processing of all raw sensor data inputs 13A, 15B and 16B into a central data management system with the CPU 2, and the creation of solitary time-stamped data leads to a high level of data reliability for driving the function of any of the safety critical equipment.

The safety critical equipment systems within the well safety systems module 10 are still the SS BOP 11, diverter 12, and RGH/QCA 14. In the system shown in FIG. 3, however, the central CPU 2 orchestrates an automated decision process based on the processed sensor input data from 13A, 15B and 16B. The analysis of the sensor data inputs is completed within the algorithms of the embedded kick detection module 17, processed within the CPU 2, and stored and time-stamped within the data logger and storage module 4.

Based on the analysis results from the kick module 17 a kick event may be detected, and in this case the DCMS automatically initiates a well shut in or riser gas handling procedure. Upon confirmation of the event within the kick detection module 17, the CPU 2 automatically relays the operational sequence to which functions the safety critical equipment such as the SS BOP 11, the diverter 12, or the RGH/QCA 14, depending on the nature of the event. Simultaneously, the status of the rig systems modules 5 and 7 are assessed by the CPU 2, such that the safety critical equipment is not functioned before other systems can be shut down or adjusted to prevent other catastrophic events from occurring. For example if the rig pump is running upon the confirmation of a kick detection event, the DCMS shuts down the pump before closing the SS BOP 11 to prevent over pressuring of the riser and/or wellbore when the SS BOP closes. The entire sequence, from event detection to response, is fully automated and without human intervention.

The goal of the inventive system and method is to enhance the well safety systems module 10 which functions the critical safety equipment by increasing the reliability of the data input and interpretation through the management and handling of the kick detection sensor data inputs within the DCMS CPU 2. Ultimately, the DCMS CPU 2 compiles and processes kick detection data streams within its operating platform versus three separate processing centres for the external data monitoring systems and CPU's currently used. The result is a higher degree of quality control on the data, as it is not relying on multiple external processing sources with each source having its own varying level of quality control. Certainty is reinstated into the well safety systems module 10 as the DCMS CPU 2 becomes the central data quality control point. With a common CPU 2, the data streams are assigned a common time stamp code making it easier to monitor, compare, and track the progress of all the raw data feeds from the array of sensor inputs over time. Thus, the inventive system and method may result in an enhancement in the data reliability for functioning the safety critical equipment systems on the floating installation, processed within the DCMS CPU 2.

Referring now to FIG. 4, this shows a series of flow charts illustrating the evolution towards a fully autonomous well safety system, and reveals the progression of kick detection data monitoring and data quality control and fully automated safety critical equipment functionality.

Flow chart 4A represents a typical well safety system present on a floating installation, such as the prior art system shown in and described above in relation to FIG. 1. In this system, there are multiple sources of data monitoring for kick detection, such as the mudlogger system, the rig's kick detection system specific to the DCMS, and the DKDS. The result is multiple CPU's required to process the raw sensor data for each of the data sources, with each source producing its independently quality controlled data stream. Through the manual monitoring of these separate and independent data streams, data is analyzed and compared between these systems to determine if a kick event has occurred 41.

A manual decision making process 42 is required upon interpretation of the multiple source data from 41 to confirm if a kick event has occurred and if the well shut in procedure should be implemented. For example, if the trip tank volume is increasing more than theoretical pipe displacement while tripping into the wellbore, a manual flow check may be performed. If the well is flowing, confirmation of the kick event is established and the well should be shut in. A verbal order is given to initiate the well shut in procedure, and human intervention is essential at this stage to initiate the procedure 43. Personnel manually function 44 the controls of the safety critical equipment, in this case the SS BOP 45. Kick event detection to the completion of the shut in procedure is entirely a manual operation.

Flow chart 4B represents the initial step towards enhancing the well safety system through improving data reliability and automated kick event determination, as shown in and described above in relation to FIG. 2. Multiple sources of data monitoring for kick detection still remain, but the approach to sensor data processing and interpretation changes. Each source processes its raw sensor data using its respective CPU, however, the DKDS CPU acts as the central data acquisition point. The DKDS CPU provides a single third party quality control for the processed sensor data output from the CPU's of the Mudlogging and rig kick detection systems 46 as well as processing and quality control of its own raw sensor data inputs.

The algorithms within the DKDS CPU analyze and interpret the multiple data source inputs and automatically confirm a kick event has occurred, raising an alarm to initiate the well shut in procedure 47. This phase of the decision process becomes automated when compared to chart 4A. However, at this stage, human intervention is still required to initiate the shut in procedure and perform the functioning of the safety critical equipment.

Personnel manually function 49 the controls of the safety critical equipment, in this case the SS BOP 50. With this system present, kick event detection and the decision to shut in the well is automated through the DKDS, with the closing of the SSBOP being an entirely manual operation.

Flow chart 4C represents a further enhanced well safety system according to the inventive system described above and shown in FIG. 3, showing a further enhancement in the well safety system through additional improvements in data reliability and fully automated decision process and safety critical equipment functionality. A kick module encompassing all of the independent sensor inputs from the DKDS, Mudlogging, and rig kick detection systems is embedded within the DCMS. This results in a single monitoring and detection system with multiple independent sensor inputs. The processing of the raw sensor data inputs is performed by the central CPU of the DCMS, and thus provides the focal point for qualitative data checking and interpretation of the raw data inputs 51.

The algorithms within the kick detection module analyse and interpret the independent sensor data streams—processed within the central CPU—and confirms when a kick event has been detected. The kick detection module confirms the event and automatically prompts to shut in the wellbore. A cross check with the rig systems modules assesses if any of the rig's systems require shutdown or adjustment before closing the SSBOP. The inventive system 52 automatically closes the SSBOP 53 without the need for human intervention, and this sequence is initiated through the DCMS CPU once the kick module prompts a well shut in.

With the system shown in FIG. 3, the decision to shut in the well, and the closing of the SSBOP (or any other safety critical equipment function) is a fully automated process.

Flow chart 4D represents a further development of the inventive system, where the Safety Integrity Level (SIL) 3 is implemented into the well safety system in addition to the features disclosed in flow chart 4C.

The SIL is actually a dependability measure or the "reliability" of the overall safety function being performed collectively by a specific safety system from sensor to equipment actuation; in this particular case the safety system being the well safety system. There are four different safety levels (1 to 4) which describe the measures for handling the risks of collective systems and system components. These four safety levels are the safety integrity level (SIL) defined by the standards and guidelines defined by certificate IEC 61508, Sector IEC 61511 for the Oil and Gas Industry. To achieve a SIL 3 rating, the calculated failure probability for the total system must include systematic (software) and random (hardware/equipment) failures. For example with the well safety system, failures can occur in both the software (sensors, CPU, data systems, etc) and the safety critical equipment (SSBOP controls, SSBOP rams, QCA, etc). Therefore to attain a SIL 3 rating for the system, the sensor and data systems and the safety critical equipment must be designed with SIL 3 components. A qualitative method is used to calculate the SIL required, which uses a probabilistic analysis of the extent of damage estimation, duration of stay of people within the area, the aversion level to danger, and the probability of occurrence. The probability can be determined by analysis of failure rates in comparable situations, data from relevant databases, and the application of appropriate prediction methods.

As the kick detection component of the well safety system is continuously in use it is considered a high demand operation. Thus, for a flawless inventive system and method a SIL 3 rating provides at least one contingency or back up to any component that fails within the safety system, such that the effectiveness of the safety system is not altered and it can still perform its function. For example, in a "perfect world" scenario there would be complete dual redundancy within the system—two sensor and data systems 54, two SSBOP control systems, and two SSBOP's (or two of any safety critical equipment) 56 to provide the system 55 continues to automatically function regardless of any component failure.

Also in order to achieve SIL3 compliance the human error factor, i.e. the ability for a human to directly interfere in the process of a Safety Critical Process must be eliminated and this is demonstrated in flow chart 4D.

Figure 5:
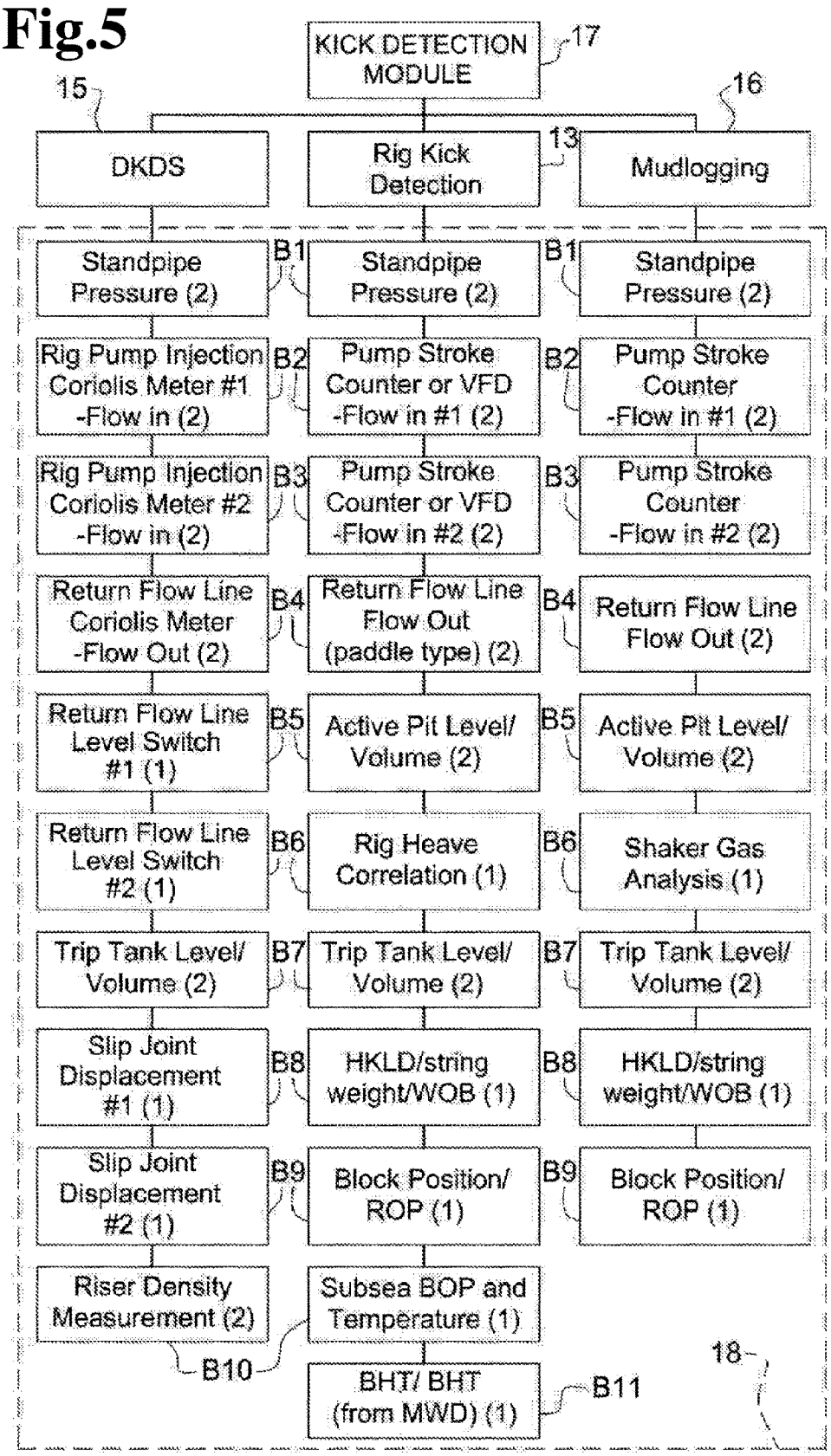
FIG. 5 is a diagram illustrating the subsystems of the kick detection module of the system shown in FIG. 3 and their respective independent sensor systems.

Referring now to FIG. 5, this lists all the field devices which provide individual sensor inputs within the kick detection module 17. The kick detection module 17 receives the raw sensor inputs from the DKDS 15, the rig kick detection 13, and the Mudlogging 16 subsystems. The DKDS system consists of sensor inputs 15B1 to 15B10, the rig kick detection system consists of sensor inputs 13B1 to 13B11, and the Mudlogging system consists of sensor inputs 16B1 to 16B9. Thus, the sensor inputs of the kick module 17 are three independent sensor systems transmitting raw data to the kick detection module 17 embedded within the DCMS architecture, and are processed by the DCSM CPU. It is appreciated that more than three independent sensor systems may be possible for the inventive system and method.

The sensors associated with the DKDS may include a standpipe pressure sensor, a rig pump injection Coriolis flow meter, a return line Coriolis flow meter, a return line level switch, a trip tank level/volume sensor, a slip joint displacement sensor and a riser fluid density sensor. The sensors associated with the rig kick detection system 13 may include a standpipe pressure sensor, a rig injection pump stroke counter, a return line flow meter, an active pit level/volume sensor, a rig heave correlation sensor, a trip tank level/volume sensor, an Hookload (HKLD)/string weight/Weight on Bit (WOB) sensor, a block position/ROP sensor, a subsea BOP and temperature sensor, and bottom hole temperature and pressure sensors. The mudlogging system 16 sensors may include a standpipe pressure sensor, a rig injection pump stroke counter, a return line flow meter, an active pit level/volume sensor, a shaker gas analysis sensor, a trip tank level/volume sensor, an Hookload (HKLD)/string weight/Weight on Bit (WOB) sensor, and a block position/ROP sensor.

An example of the kick detection process in the system shown in FIG. 4 is as follows. The return flow line Coriolis flow out rate 15B4 may increase when an influx enters the wellbore. If this occurs, this is detected as the output from the return flow line Coriolis flow meter from the DKDS 15 analyzed within the algorithms of the kick detection module 17 and processed within the central CPU 2. The anomaly is identified and an alarm triggered through the kick detection module 17, while the algorithms cross check the other sensor inputs (such as return flow rate sensors 13B4 and 16B4 in the rig detection system 13 and the mudlogging system 16) for any indications of inflow from the wellbore. One or more positive kick indicators from the analysis of additional individual sensors within the kick detection module 17 confirm the event, identified through the algorithms of the module 17. The status of the rig system modules 5 and 7 are assessed by the CPU 2 before any safety critical equipment is functioned, and any equipment which requires adjustment or manipulation is completed beforehand. The CPU 2 then automatically relays the sequence to the well control systems module 10 which shuts in the wellbore through the automated functioning of the SS BOP 11.

FIG. 5 can also be used to introduce the concepts of the Available Safety System Level (ASSL), Staged Sensor Degradation (SSD), and Minimum Allowable Safety System Level (MASSL).

For example, string weight may change when an overpressured zone is penetrated. The rig kick detection Hookload (HKLD) sensor 13B8 may exhibit this change in the string weight as gas infiltrates the wellbore. The kick detection module 17 identifies this within its algorithms, and may cross check this with the other independent Hookload (HKLD) sensor 16B8 of the Mudlogging system 16 for confirmation that the change is occurring. Another example may be the Mudlogging system 16 trip tank volume/level sensor 16B7 is increasing as pipe is removed from the well. This is identified through the algorithms of the kick detection module. This may be cross checked with the independent trip tank level sensor 15B7 of the DKDS 15, and the independent trip tank level sensor 13B7 of the rig kick detection system 13. Thus, the various sensor input sources transmitting raw data to the kick detection module 17 allows the system to cross check independent sensors measuring the same parameter, ultimately improving data reliability. Data validity is confirmed through the quality control of the raw data feeds being processed by the central CPU.

Using the tabled array of sensor inputs, the concept of ASSL 18 is introduced by the inventive system and method. The ASSL 18 is an aggregate safety score for the system represents the total available sensor monitoring capacity for the kick detection module 17, which translates to a level of safety available to the operations. For example, with the system disclosed in FIG. 5, there are a total of 28 sensors for kick detection monitoring distributed across three systems 13, 15 and 16 within the kick detection module 17. A number may be assigned to the ASSL 18 to symbolize the available safety level provided by the kick detection module 17, which ultimately represents the level of safety for the well safety systems module of the floating installation.

For example, an ASSL value of 3 may represent the three independent sensor systems 13, 15 and 16 at full monitoring capacity. Each sensor may be assigned a weighted value—a numerical importance level, with more critical sensors involved in positive kick indication weighted with a higher value. A return flow rate sensor may carry a weighting 2, while a Hookload sensor may carry a weighting of 1.

Each subsystem 13, 15 and 16 of the kick detection module thus carries a total safety score determined using the numerical importance level for each sensor in the subsystem 13, 15, 16. In this example the safety score is the sum of the importance levels. The aggregate safety score is determined by adding a first value for each subsystem with a safety score greater than a predetermined value and adding a second value for the or each subsystem with a safety score being re-evaluated each time the safety score for any of the subsystems changes. Thus when the subsystem's safety score drops below a certain value, the ASSL is reduced, in this example changing from 3 to 2 signalling a specific subsystem requires immediate attention.

Another example can illustrate this concept. A value has been assigned to each sensor in the kick detection module 17, with a value of 2 assigned to critical positive kick indicator sensors and 1 to all other sensors in the system (reflected by the number in brackets in each sensor block in FIG. 5). Therefore, by summing the values of all sensors functioning within their given subsystem 13, 15 and 16 the safety score for each subsystem becomes 16 for the DKDS 15, 17 for the rig kick detection system 13, and 14 for the Mudlogging system 16.

As the critical sensor parameters are assigned a value of 2 in this example, a decrease of 2 in the total score of a subsystem decreases the ASSL from 3 to 2. However, the algorithms within the kick detection module recognize the ranking of certain sensors with respect to others. If the block position sensor 15B9 and Hookload sensor 15B8 failed within the rig kick detection system 13, the ASSL would remain at 3 because there remains complete contingency within the Mudlogging system 16. These sensors are not generally utilized for monitoring positive kick indicators, but are still important parameters which contribute to determining if a kick may be occurring. However, the kick detection module 17 would signal the need to investigate these sensors immediately.

Using the ASSL 18 a safety system score card results, and the concept of Staged Sensor Degradation (SSD) is introduced. SSD represents the failing or malfunctioning of sensors within the subsystems 13, 15 and 16 of the kick detection module 17. Failing or malfunctioning sensors affect the overall ASSL 18 of the kick detection module 17 and decreases the overall safety level of the well safety systems. As sensor failure continues to occur, the kick detection capacity of the well safety systems module continues to decrease. At a given stage of sensor degradation, continuing with operations carries with it increased inherent risks as the kick monitoring capacity—and the level of safety—stages downwards.

The kick detection module 17 automatically identifies and determines this as an unacceptable level of risk within its algorithms, and refers to this as the Minimum Allowable Safety System Level (MASSL). Thus, once the SSD reaches the point where the ASSL 18 equals the MASSL, operations must continue with a high level of caution. The MASSL with the methodology described herein would be set at 1 and represents that there is only one functioning critical sensor remaining within the kick detection module for monitoring a key parameter used for positive kick indication.

If the last sensor fails, this forces the SSD into a final third stage and the ASSL decreases to below the MASSL—this translates to a total failure of a specific critical sensor across the subsystems 13, 15 and 16, which jeopardizes the kick detection capacity of the well safety system. With the ASSL 18 below the MASSL, the inventive system automatically ceases operations until one or more sensors can be replaced or repaired. Thus, when ASSL 18 is equal to the MASSL, sensor repair and/or replacement should occur to reinstate the ASSL 18 to an acceptable level above the MASSL and avoid non-productive time (NPT). Normally, in conventional operations, the decision to continue with operations given the sensor failures present is at the discretion of the drilling supervisor. With the inventive system and method, the decision to continue based on the ASSL 18 becomes an automated process.

For example, during tripping in or out of the hole, the loss of the Mudlogging 16 trip tank level sensor 16 B7 drops the ASSL 18. Because it is a critical sensor during tripping for monitoring for positive kick indicators the ASSL 18 decreases one level to a grading of 2. The MASSL grading is 1 and represents at least one critical sensor measuring an identical parameter must be fully functioning to continue with operations. In this example, there are two additional trip tank level sensors B3 functioning through the independent subsystems of the kick module 17 (i.e. the DKDS 15 and rig kick detection system 13). However, when SSD occurs further to a single trip tank level sensor, this would be considered the MASSL as the ASSL 18 decreases a further level to 1. The inventive system and method prompts the operator to continue with caution with the single trip tank level sensor remaining in the kick detection module 17 for tripping. At this stage at least one of the failed trip tank level sensors should be repaired to avoid non-productive time, because if the remaining trip tank sensor fails the ASSL 18 decreases to below the MASSL. The inventive system halts operations until at least one sensor is repaired and the ASSL 18 is reinstated to at least a grading of 1.

During SSD, the sensor type and the parameter it measures vary the degree to which the ASSL 18 is affected. For example, during drilling, if the Mudlogging 16 block position sensor 16 B9 is lost the loss of the ASSL 18 is quite minimal, as there is a contingency measurement within the rig kick detection system 13. If the rig kick detection 13 Hookload sensor 13 B8 then fails, the effect on the ASSL 18 is still quite minimal, as there is still a contingency measurement within the Mudlogging 16 system. Additionally, these sensors are not considered positive kick indicators, which also contributes to the degree they affect the ASSL 18 when they do fail. Thus, certain sensors possess a higher safety grading than others, such as sensors key to positive kick indication. When these key sensors start to degrade the effect on the ASSL 18 is much greater.

Referring to the same example above, when the rig kick detection system return flow rate sensor 13B4 fails, the ASSL 18 is affected to a larger degree than a combined Hookload B8 and block position sensor B9 failure. If an additional return flow line flow rate sensor B4 malfunctions this is considered a stage 2 SSD. With only a single return flow rate sensor B4 remaining the ASSL 18 is decreased to the MASSL. Beyond this operations cannot continue, because if the last sensor fails the ASSL 18 status decreases to below the MASSL the kick detection capacity is jeopardized and the floating installation is exposed. Sensor repair should commence (when feasibly possible) before this point is reached to prevent the occurrence of non-productive time.

Thus a first stage SSD occurs, referred to as SSD 1, when a single critical sensor failure occurs. A second stage SSD, referred to as SSD 2, occurs when a second critical sensor measuring the identical parameter as SSD 1 fails. If SSD 3 occurs (i.e. a third stage), and there are only three sensors measuring this parameter in the kick detection module 17 the kick monitoring capacity is at risk. This is recognized and determined by the kick detection module 17, and the inventive system automatically ceases operations until at least one sensor is repaired. Ultimately, SSD 2 places the ASSL at the MASSL and sensor repair should commence (when safe and feasible) at this point in the operation before SSD3 can occur.

It is appreciated a different numbering or lettering methodology may be used for the SSD, ASSL, and MASSL to represent the sensor degradation and safety level within the kick module.

Also it is appreciated that for one skilled in the art of kick detection, different ratings and combinations of the sensors may be used to determine SSD, ASSL and MASSL. The key inventive step is to introduce for the first time the concepts of Staged Sensor Degradation, Minimum Allowable Safety System Level and Available Safety System Level to allow full compliance to a SIL3 rated Safety System.

Figure 6:
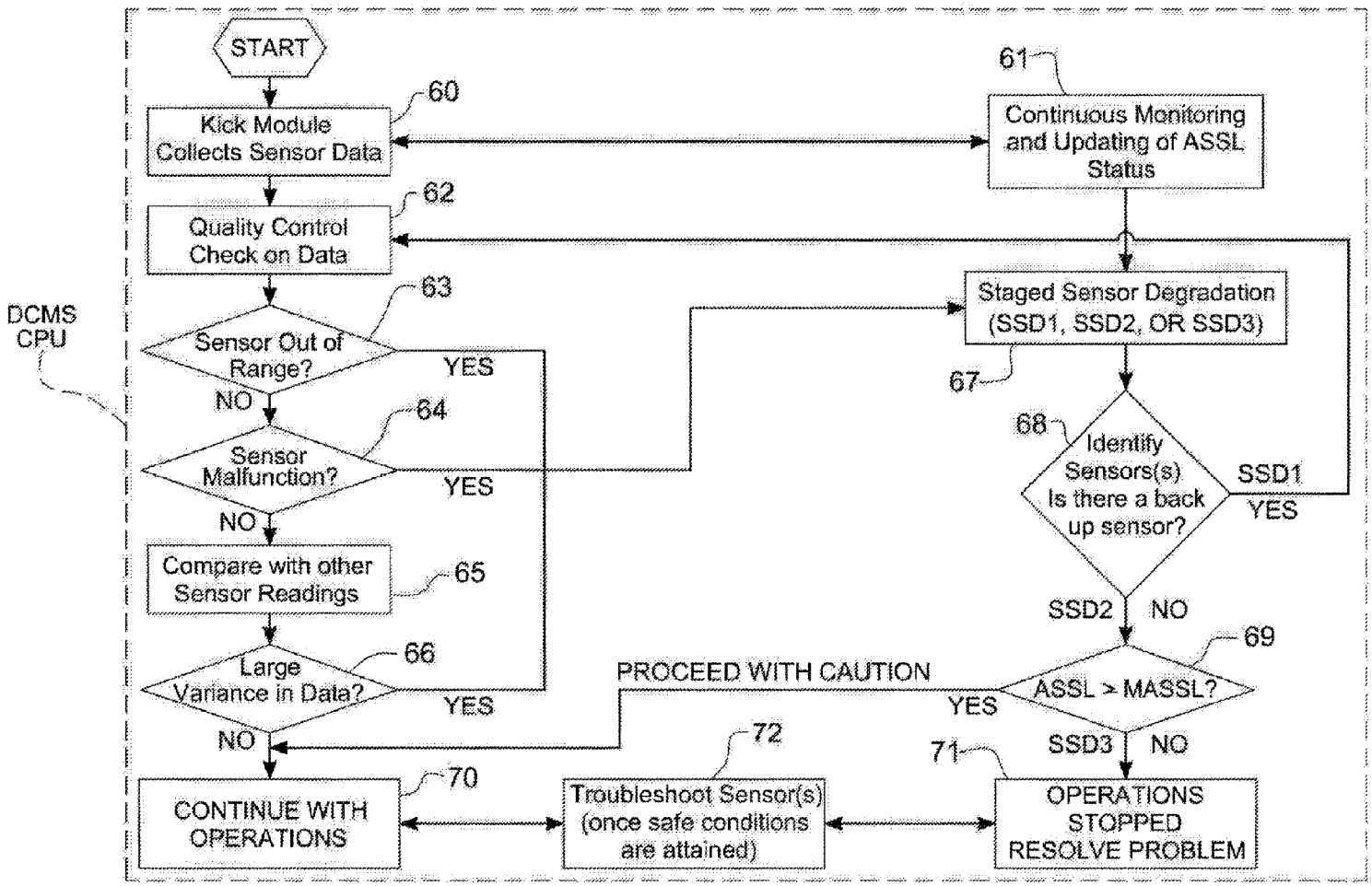
FIG. 6 shows a decision tree and flow chart showing how the systems shown in FIGS. 3 and 5 may be used.

Refer now to FIG. 6, this shows a decision tree diagram revealing the inventive system's methodology to illustrate the concepts of SSD, ASSL, and MASSL.

For the purpose of this discussion, it is assumed the current rig operation on the floating installation is drilling. It is appreciated that any other operation may be in progress such as, but not limited to, tripping, cementing or circulating. During drilling, the embedded kick module collects raw sensor data from its three independent sensor systems 60. A qualitative control check is performed on all sensor data inputs streaming into the module, processed within the algorithms of the kick module 60 through the DCMS CPU quality control check process 62. Simultaneously, the kick detection module 60 continuously assesses the ASSL status of the sensor systems 61 by continuously scanning the results of the checked data occurring within the algorithms of the kick module during the quality control check process 62. The status of the ASSL is constantly updated within the kick module, and alarms are raised within the DCSM during any SSD event and/or when the ASSL changes.

For this example, the return flow rate sensor is used to explain the inventive system methodology. It is appreciated this can be extended to any sensor present within the kick detection module. As the raw sensor data input streams into the kick module, a series of evaluations occur on the data and physical sensor. The sensor return flow rate sensor range values are examined 63 (these may be the internally fixed values specific to the sensor for ranges in flow rate, density, temperature, etc.). A sensor function check is also performed, confirming the sensor is powered up, measuring, and transmitting data 64. The algorithms compare the return flow rate readings of the sensor being assessed with the other available return flow rate sensor readings 65. It investigates if there is a large variance occurring amongst the data sets of the return flow rate sensors 66. These evaluation steps are performed entirely within the algorithms of the kick module, and if one or more of these assessments fail the ASSL assessment sequence identifies this during its update sequence 67, and the kick module is updated accordingly 61. Otherwise, drilling operations continue unimpeded 70.

The ASSL update sequence 67 is as follows when a return flow rate sensor malfunctions 64, falls out of range 63, or exhibits a large variation in its data 66 when compared to other return flow rate sensors 65 and the kick module scans the entire array of sensors within the system, and identifies if there are one or more fully functional return flow rate sensors present 68. If two are present, this is considered a stage one SSD (SSD1), drilling continues, and the remaining return flow sensors are monitored as the ASSL remains above the MASSL. If there is only a single return flow rate sensor functioning, this is considered a stage two SSD (SSD2) because there are no contingent sensors remaining. The algorithms evaluate the ASSL and compare it to the MASSL 69, and if the ASSL status is greater than or equal to the MASSL drilling continues with a high level of caution 70 with immediate attention required to troubleshoot and repair at least one sensor 72. Failure to replace or repair a return flow rate sensor at this stage could result in non-productive time if the remaining return flow rate sensor fails.

If the remaining flow rate sensor fails before a contingent return flow rate sensor is brought back online within the kick detection module, the ASSL status decreases below the MASSL 69. This is considered a stage three SSD (SSD3) and an alarm is triggered within the kick detection module and signaled to the DCMS. The system automatically determines drilling cannot continue because of the unacceptable risks of reliably detecting kick or loss occurrence from failed return flow rate sensors 71. The failed return flow rate sensors expose the rig and personnel to unnecessary risk if operations continue, and the inventive system and method ceases the drilling operation 71. The return flow rate sensors are repaired and/or replaced once it is safe to do so 72 to reinstate the ASSL status to above the MASSL so operations can continue. In this instance, NPT is incurred on the floating installation.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the present invention in diverse forms thereof. Reference should also be had to the appended claims.

What is claimed is:

1. A drilling system for drilling a subterranean well bore, the system comprising:

a controller; and at least two sets of field devices comprising a first set of field devices and a second set of field devices, each of the at least two sets of field devices being configured to measure a physical characteristic of the drilling system and to transmit to the controller signals representing a measured value of the physical characteristic, wherein, the controller is programmed to use a first set of algorithms to process the signals received from the first set of field devices to determine if the measured values represented by the signals indicate that there might have been an influx of formation fluid into the subterranean well bore, the controller is programmed to use a second set of algorithms to process the signals received from the second set of field devices to determine if the measured values represented by the signals indicate that there might have been an influx of formation fluid into the subterranean well bore, each of the at least two sets of field devices comprises at least one field device, and wherein the controller is further programmed, to assign a numerical importance level to each of the at least one field device, to use the numerical importance level of each of the at least one field device in each of the first set of field devices or in the second set of field devices to assign a safety score for each of the first set of field devices or the second set of field devices, and to subtract from the safety score the numerical importance level of any of the at least one field device determined to be faulty.

2. The drilling system as recited in claim 1, wherein, the at least two sets of field devices further comprises a third set of field devices configured to measure a physical characteristic of the drilling system and to transmit to the controller signals representing a measured value of the physical characteristic, and the controller is further programmed to use a third set of algorithms to process the signals received from the third set of field devices to determine if the measured values represented by the signals indicate that there might have been an influx of formation fluid into the subterranean well bore.

3. The drilling system as recited in claim 2, wherein the third set of field devices comprises at least one field device, and each one of the at least one field device is included in only one of the at least three sets of field devices.

4. The drilling system as recited in claim 3, wherein the controller is further programmed, to assign a numerical importance level to each of the at least one field device, to use the numerical importance level of each of the at least one field device in each of the first set of field devices, the second set of field devices, or the third set of field devices to assign a safety score for each of the first set of field devices, the second set of field devices, or the third set of field devices, and to subtract from the safety score the numerical importance level of any of the at least one field device determined to be faulty.

5. The drilling system as recited in claim 2, wherein the controller is further programmed so that, if one of the first set of algorithms, the second set of algorithms, and the third set of algorithms reaches a conclusion that there might have been an influx of formation fluid into the subterranean well bore, the controller automatically analyses the signals received from another of the at least two sets of field devices to corroborate the conclusion.

6. The drilling system as recited in claim 2, wherein, the controller comprises at least one microprocessor, and each of the at least one microprocessor is configured to use a common clock signal, to receive the signals from the at least two sets of field devices, and to record a time of receipt of each of the signals using the common signal clock.

7. The drilling system as recited in claim 2, wherein each of the at least two sets of field devices is different.

8. A controller for controlling a drilling system for drilling a subterranean well bore, the controller being programmed to, process signals received from at least two sets of field devices comprising a first set of field devices and a second set of field devices, each of at least one two sets of field devices being operable to measure a physical characteristic of the drilling system and to transmit to the controller signals representing a measured value of the physical characteristic, each of the at least two sets of field devices comprising at least one field device, to use a first set of algorithms to process the signals received from the first set of field devices to determine if the measured values represented by the signals indicate that there might have been an influx of formation fluid into the subterranean well bore, to use a second set of algorithms to process the signals received from the second set of field devices to determine if the measured values represented by the signals indicate that there might have been an influx of formation fluid into the subterranean well bore, to assign a numerical importance level to each of the at least one field device, to use the numerical importance level of each of the at least one field device in each of the first set of field devices or in the second set of field devices to assign a safety score for each of the first set of field devices or the second set of field devices, and to subtract from the safety score the numerical importance level of any of the at least one field device determined to be faulty.

9. The controller as recited in claim 8, wherein, at least two sets of field devices further includes a third set of field devices which is operable to measure a physical characteristic of the drilling system and to transmit to the controller signals representing a measured value of the physical characteristic, and the controller is further programmed to use a third set of algorithms to process the signals received from the third set of field devices to determine if the measured value represented by the signals indicate that there might have been an influx of formation fluid into the subterranean well bore.

10. The controller as recited in claim 9, wherein, the third set of field devices comprises at least one field device, and the controller is further programmed, to assign a numerical importance level to each of the at least one field device, to use the numerical importance level of each of the at least one field device in each of the first set of field devices, the second set of field devices, or the third set of field devices to assign a safety score to each of the first set of field devices, the second set of field devices, or the third set of field devices, and to subtract from the safety score the numerical importance level of any of the at least one field device determined to be faulty.

11. The controller as recited in claim 9, wherein the controller is further programmed so that if one of the first set of algorithms, the second set of algorithms, and the third set of algorithms sets of algorithms reaches a conclusion that there might have been an influx of formation fluid into the subterranean well bore, the controller automatically analyses the signals received from another of the at least two sets of field devices to corroborate the conclusion.

12. The controller as recited in claim 9, wherein, the controller comprises at least one microprocessor, and each of the at least one microprocessor is configured to use a common clock signal, to receive the signals from the at least two sets of field devices, and to record a time of receipt of each of the signals using the common signal clock.

13. A system for drilling a subterranean well bore, the system comprising:

a controller;

at least one drilling control device; and at least one field device;

wherein, the controller is connected to the at least one drilling control device so that the controller controls a drilling by effecting an operation of the at least one drilling control device, the controller is connected to the at least one field device, the at least one field device is configured to measure a physical characteristic of the system and to transmit to the controller signals representing a measured value of the physical characteristic, the controller is programmed to process the signals received from the at least one field device and to determine if the measured value represented by the signals indicate that there might have been an influx of formation fluid into the subterranean well bore, the at least one field device is provided in each of at least three sets of field devices comprising a first set of field devices, a second set of field devices, and a third set of field devices, and the controller is further programmed, to use a first set of algorithms to process the signals received from the first set of field devices to determine if the measured values represented by the signals indicate that there might have been an influx of formation fluid into the subterranean well bore, to use a second set of algorithms to process the signals received from the second set of field devices device to determine if the measured values represented by the signals indicate that there might have been an influx of formation fluid into the subterranean well bore, and to use a third set of algorithms to process the signals received from the third set of field devices to determine if the measured values represented by the signals indicate that there might have been an influx of formation fluid into the subterranean well bore.

14. The system as recited in claim 13, wherein the controller comprises at least one microprocessor, each of the at least one microprocessor being configured to use a common clock signal, to receive the signals from the at least one field device, and to record a time of receipt of each of the signals using the common signal clock.

15. The system as recited in claim 13, wherein each of the at least two sets of field devices are different.

16. The system as recited in claim 13, wherein each field device of the at least two sets of field devices measures a physical characteristic of the drilling system which is the same as the field device of one or both of the other of the at least two sets of field devices.

17. The system as recited in claim 13, wherein each field device is included in only one of the at least two sets of field devices.

18. The system as recited in claim 13, wherein the controller is further programmed so that if one of the first set of algorithms, the second set of algorithms and the third set of algorithms determines that there might have been an influx of formation fluid into the subterranean well bore, the controller automatically analyses the signals received from another of the at least two sets of field devices to corroborate the conclusion.

19. The system as recited in claim 13, wherein the controller is further programmed so that, when one of the at least one field device is determined to be a faulty field device, the controller, determines whether or not another field device is active which measures a same physical characteristic of the system, assigns a higher importance level to the faulty field device if no such another field device exists, assigns a lower importance level to the faulty field device if another field device is active which measures the same physical characteristic of the system, before then recalculating the safety score of the set of field devices.

20. The system as recited in claim 13, wherein the controller is further programmed, to assign a numerical importance level to each of the at least one field device, to use the numerical importance level of each of the at least one field device in each of the first set of field devices, the second set of field devices, or the third set of field devices to assign a safety score to each of the first set of field devices, the second set of field devices, or the third set of field devices, and to subtract from the safety score the numerical importance level of any of the at least one field device determined to be faulty.

21. The system as recited in claim 20, wherein the controller is further programmed so that the numerical importance level assigned to each of the at least one field device depends on a type of drilling operation in progress at the time.

* * * * *